US008998354B2

(12) United States Patent
Wach et al.

(10) Patent No.: US 8,998,354 B2
(45) Date of Patent: Apr. 7, 2015

(54) THERMALLY EFFICIENT REFRIGERATOR DOOR AND FRAME

(71) Applicant: Anthony, Inc., Sylmar, CA (US)

(72) Inventors: Robert Ryan Wach, Glendale, CA (US); John Michael Roche, Bishop, GA (US); Sesha Madireddi, St. Charles, MO (US); Raghujit Kunapuli, St. Charles, MO (US); Sai Prakash Putti, Athens, GA (US)

(73) Assignee: Anthony, Inc., Sylmar, CA (US)

( * ) Notice: Subject to any disclaimer, the term of this patent is extended or adjusted under 35 U.S.C. 154(b) by 4 days.

(21) Appl. No.: 13/871,304

(22) Filed: Apr. 26, 2013

(65) Prior Publication Data

US 2013/0285517 A1 Oct. 31, 2013

Related U.S. Application Data

(60) Provisional application No. 61/638,879, filed on Apr. 26, 2012.

(51) Int. Cl.

| | |
|---|---|
| ***A47F 3/00*** | (2006.01) |
| ***A47F 3/04*** | (2006.01) |
| *E06B 1/52* | (2006.01) |
| *E06B 3/36* | (2006.01) |
| *E06B 3/66* | (2006.01) |

(52) U.S. Cl.

CPC ..... *A47F 3/0434* (2013.01); *E06B 1/524* (2013.01); *A47F 3/043* (2013.01); *E06B 3/362* (2013.01); *E06B 3/6617* (2013.01)

(58) Field of Classification Search

CPC ..... A47F 3/043; A47F 3/0434; F25D 23/062; F25D 23/069

USPC ..... 312/116, 138.1, 401, 405, 407; 49/501, 49/504; 62/246

See application file for complete search history.

(56) References Cited

U.S. PATENT DOCUMENTS

| | | | | |
|---|---|---|---|---|
| 4,087,139 | A * | 5/1978 | Heaney | 312/321.5 |
| 4,496,201 | A * | 1/1985 | Allgeyer | 312/296 |
| 4,818,043 | A * | 4/1989 | Borgen | 312/138.1 |
| 4,998,382 | A | 3/1991 | Kostos | |
| 5,111,618 | A * | 5/1992 | Kaspar et al. | 49/501 |
| 5,255,473 | A * | 10/1993 | Kaspar et al. | 49/501 |
| RE35,149 | E * | 1/1996 | Richardson et al. | 52/204.593 |

(Continued)

OTHER PUBLICATIONS

International Search Report and Written Opinion issued on Aug. 9, 2013, in related PCT/US2013/038394 application.

*Primary Examiner* — Matthew Ing

(74) *Attorney, Agent, or Firm* — Jeffers Mangels Butler & Mitchell LLP; Brennan C. Swain, Esq.

(57) ABSTRACT

A door frame for a refrigerator display case that includes an inner metal member, an outer metal member, and first and second single plastic modules sandwiched between the inner and outer metal members. The inner and outer metal members and first and second plastic modules cooperate to define first and second door openings. The first and second single plastic modules each include a jamb middle plastic section, a header middle plastic section, a sill middle plastic section and a mullion middle plastic section. The first and second single plastic modules are adhered to the inner metal member and the outer metal member, and the first mullion plastic section and the second mullion plastic section are not adhered to one another.

10 Claims, 23 Drawing Sheets

(56) References Cited

U.S. PATENT DOCUMENTS

| | | | | |
|---|---|---|---|---|
| 5,645,330 | A * | 7/1997 | Artwohl et al. | 312/116 |
| 5,910,083 | A * | 6/1999 | Richardson et al. | 52/171.1 |
| 6,367,223 | B1 * | 4/2002 | Richardson et al. | 52/656.9 |
| 6,578,978 | B1 | 6/2003 | Upton | |
| 6,637,093 | B2 * | 10/2003 | Richardson et al. | 29/458 |
| 2002/0073645 | A1 | 6/2002 | Richardson | |
| 2008/0122324 | A1 * | 5/2008 | Bienick | 312/116 |

* cited by examiner

THERMALLY EFFICIENT REFRIGERATOR DOOR AND FRAME

CROSS REFERENCE TO RELATED APPLICATIONS

This application claims the benefit of U.S. Provisional Application No. 61/638,879, filed Apr. 26, 2012, which is incorporated herein by reference in its entirety.

FIELD OF THE INVENTION

The present invention relates generally to refrigerated display cases, and, more particularly, to a thermally efficient refrigerator door and frame for a refrigerated display case.

BACKGROUND OF THE INVENTION

Existing door frames are commonly constructed of hollow U-shaped aluminum extrusion profiles wrapped in plastic. With an application temperature of −15° F. in the refrigerator, and 75° F. and 55% relative humidity (RH) in the room, the thermal insulation of this construction is insufficient for the exterior to stay above the ambient dewpoint of 58° F. As a consequence, this frame requires about 100 watts/door of anti-sweat heaters to prevent exterior condensation in typical applications.

Earlier attempts to improve thermal resistance of the frame involved using fiberglass pultrusion profiles stuffed with extruded polystyrene foam insulation. This design resulted in a frame which requires about 50 watts/door of anti-sweat to prevent exterior condensation. Fiberglass pultrusion was selected to provide reduced thermal resistance versus aluminum. For example, the thermal conductivity of aluminum is 273,000 mW/m-K versus fiberglass pultrusion at 577 mW/m-K, versus rigid PVC at 170 mW/m-K. Earlier frames used aluminum or fiberglass materials for their relatively high structural strength and low coefficient of thermal expansion (CTE). While PVC provides superior thermal resistance, it lacks sufficient structure and has a high CTE which can be detrimental in freezer applications. A typical freezer door frame application can see a temperature differential of about 90° F. (75° F. outside to −15° F. inside). With a high CTE, the unrestricted shrink can be significant over a typical 153" 5-door frameset length. For example, the CTE of aluminum, fiberglass, and rigid PVC are 12.8, 4.72, and 28.9 in/in ° F., respectively. This results in an unrestricted shrink over 153" of 0.176", 0.065", and 0.398", respectively. This large shrink for PVC may cause it to crack when screwed to a wood or steel freezer opening.

Earlier frames also suffer from the challenges of providing a structural joint without compromising thermal insulating performance. Some manufacturers weld the aluminum jambs to the header and sill members, and rivet the mullions in place using steel brackets. Foam rubber inserts are added to reduce infiltration air in these mechanically constructed corners. Other manufacturers use molded plastic corner and mullion brackets to screw the frame together. The relatively higher thermal conductivity of these molded plastic bracket result in these locations being the coldest, and thus the first places to experience external condensation.

SUMMARY OF THE PREFERRED EMBODIMENTS

In accordance with a first aspect of the present invention there is provided a door frame for a refrigerator display case that includes an inner metal member, an outer metal member, and first and second single plastic modules sandwiched between the inner metal member and the outer metal member. The inner metal member, outer metal member and first and second plastic modules cooperate to define first and second door openings. The first single plastic module includes a first jamb middle plastic section, a first header middle plastic section, a first sill middle plastic section and a first mullion middle plastic section. The second single plastic module includes a second jamb middle plastic section, a second header middle plastic section, a second sill middle plastic section and a second mullion middle plastic section. The first mullion plastic section is positioned adjacent the second mullion plastic section. The first and second single plastic modules are adhered to the inner metal member and the outer metal member, and the first mullion plastic section and the second mullion plastic section are not adhered to one another.

In a preferred embodiment, the first mullion plastic section and the second mullion plastic section include a seal plate attached thereto. The seal plate preferably includes a center metal section and first and second outwardly extending plastic legs. The first plastic leg is secured to the first mullion plastic section and the second plastic leg is secured to the second mullion plastic section. Preferably, the center metal section is encapsulated in plastic and the first and second plastic legs each include a hook that is snap fit into a corresponding recess defined in the first mullion plastic section and the second mullion plastic section, respectively. In a preferred embodiment, the inner metal member comprises a u-shaped cross-section and the first mullion plastic section and the second mullion plastic section cooperate to define a first channel in which the inner metal member is seated. In a preferred embodiment, the outer metal member comprises a generally u-shaped cross-section and the first mullion plastic section and the second mullion plastic section cooperate to define a second channel in which the outer metal member is seated. Preferably, the first and second single plastic modules are adhered to the inner metal member and the outer metal member by acrylic tape.

In accordance with another aspect of the present invention, there is provided a refrigerator display case door that includes a peripheral rail assembly that includes a top rail, bottom rail, hinge side rail and handle side rail that cooperate to define a space therebetween. Each of the top rail, bottom rail, hinge side rail and handle side rail include an outer metal rail portion and an inner plastic rail portion that are secured to one another. At least the hinge side rail includes a hinge opening. The door also includes a glass package secured within the space of the peripheral rail assembly that includes an inner pane, a middle pane and an outer pane that are secured within the peripheral rail assembly.

In a preferred embodiment, the outer pane is larger than the inner and middle planes and is secured to the outer metal rail portion of the top rail, bottom rail, hinge side rail and handle side rail. Preferably, the outer metal rail portion of the hinge side rail includes a c-shaped portion that at least partially defines the hinge opening. The c-shaped portion defines a gap that is adjacent the glass package. In a preferred embodiment, the outer metal rail portion and the inner plastic rail portion include complementary hooks that secure the outer metal rail portion to the inner plastic rail portion.

In accordance with yet another aspect of the present invention, there is provided a refrigerator display case door frame assembly that includes a door frame with first and second door openings having first and second doors hingedly disposed therein. The door frame includes an inner metal member, an outer metal member, and first and second single plastic modules sandwiched between the inner metal member and the outer metal member. The inner metal member, outer metal member and first and second plastic modules cooperate to define the first and second door openings. The first single plastic module includes a first jamb middle plastic section, a first header middle plastic section, a first sill middle plastic section and a first mullion middle plastic section. The second single plastic module includes a second jamb middle plastic section, a second header middle plastic section, a second sill middle plastic section and a second mullion middle plastic section. The first mullion plastic section is positioned adjacent the second mullion plastic section. The first and second single plastic modules are adhered to the inner metal member and the outer metal member, and the first mullion plastic section and the second mullion plastic section are not adhered to one another. The first and second doors each include a peripheral rail assembly that includes a top rail, bottom rail, hinge side rail and handle side rail that cooperate to define a space therebetween and each of the top rails, bottom rails, hinge side rails and handle side rails include an outer metal rail portion and an inner plastic rail portion that are secured to one another. The first and second doors each also include a glass package secured within the space of the peripheral rail assembly that includes an inner pane, a middle pane and an outer pane that are secured within the peripheral rail assembly.

DETAILED DESCRIPTION OF THE PREFERRED EMBODIMENTS

Figure 1:
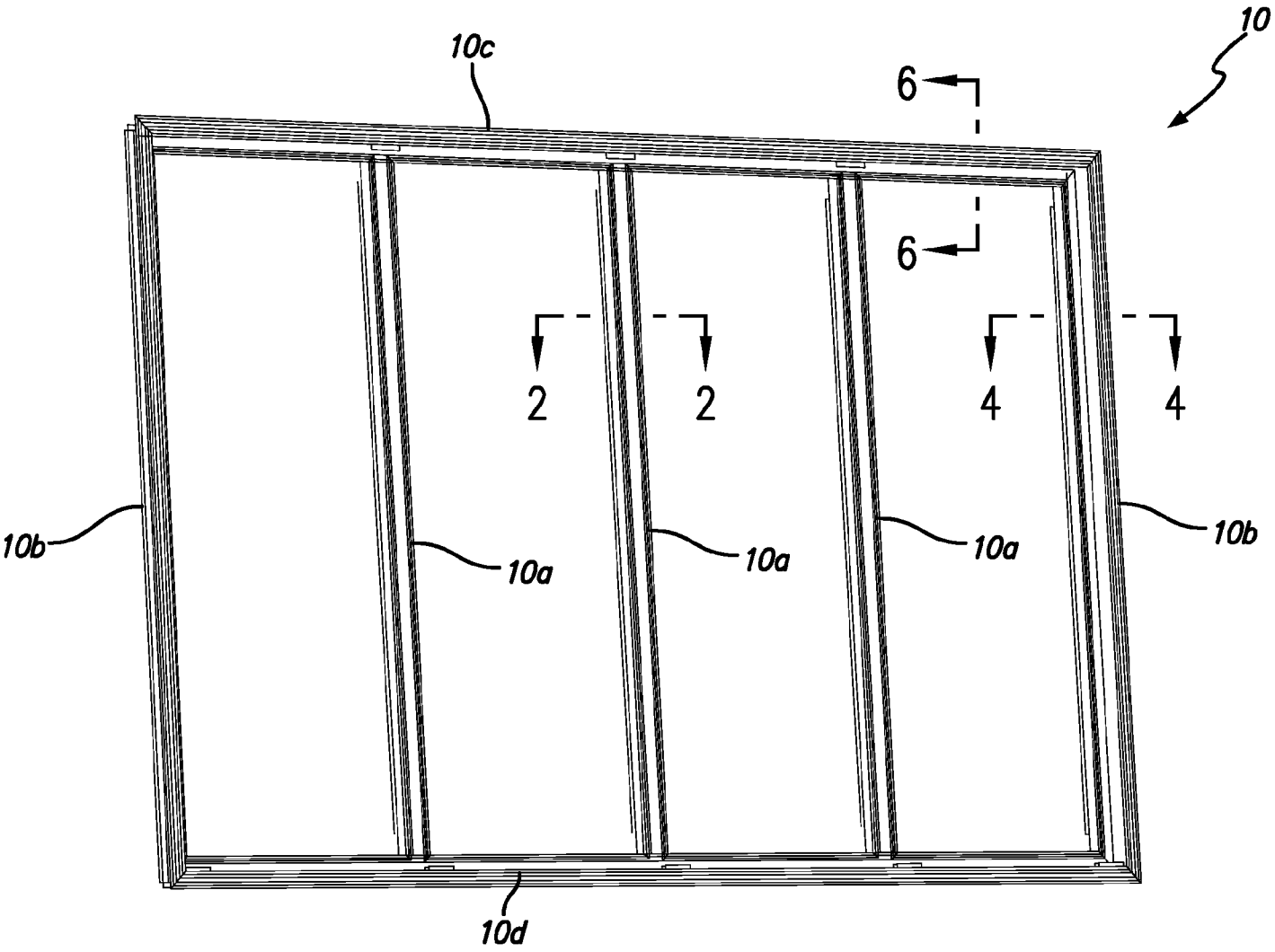
FIG. 1 is a perspective view of a refrigerator door frame having space therein for four doors in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The use of the phrase "in one embodiment" or "in another embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "outer," "back," "top," "bottom," "side," "short," "long," "up," "down," and "below" used herein are merely for ease of description and refer to the orientation of the components as shown in the figures. It should be understood that any orientation of the components described herein is within the scope of the present invention.

Figure 14:
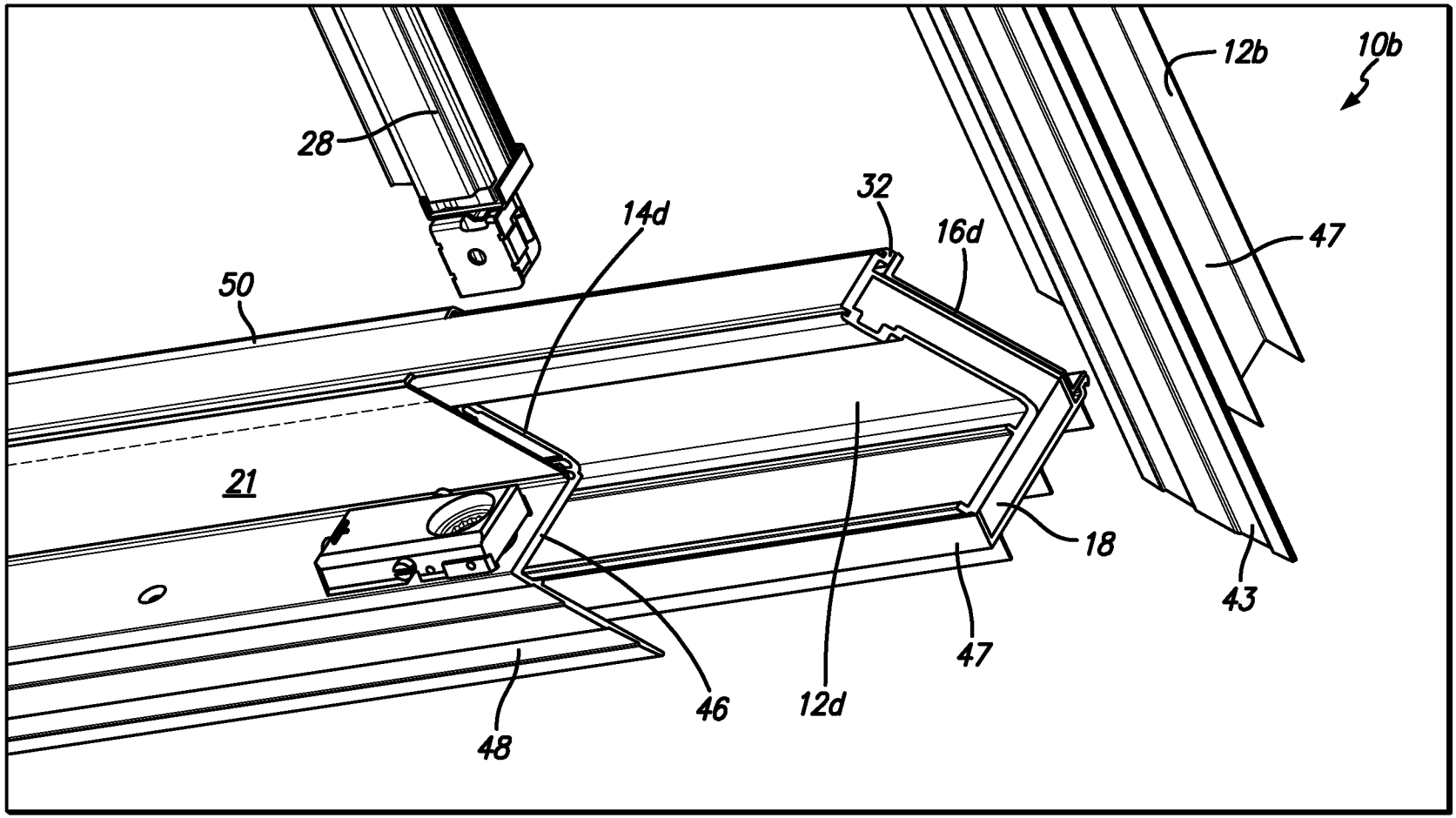
FIG. 14 is an outer exploded perspective view of the bottom right corner of the frame.

With reference to FIGS. 1-17, generally, the present invention includes a refrigerator door frame 10 that includes an aluminum, PVC, and aluminum sandwich structure, bonded together with compliant structural adhesive or acrylic tape (exemplary placement is shown as dashed lines in FIG. 2) to provide a thermally efficient refrigerator/freezer door frame 10. As shown in FIG. 1, the frame 10 includes mullion sections 10*a*, jamb sections 10*b*, a header section 10*c* and a sill section 10*d*. Each of these sections includes at least one middle plastic section 12, an outer metal member 14 and a inner metal member 16. It will be appreciated that "inner" and "outer" refers to the orientation of the components with respect to a refrigerator display case. The mullion sections 10*a* include two adjacent mullion middle plastic sections 12*a*, a mullion outer metal member 14*a* and a mullion inner metal member 16*a* (see FIG. 2); the jamb sections 10*b* include a jamb middle plastic section 12*b*, a jamb outer metal member 14*b* and a jamb inner metal member 16*b* (see FIG. 4); the header section 10*c* includes a header middle plastic section 12*c*, a header outer metal member 14*c* and a header inner metal member 16*c* (see FIG. 6); and the sill section 10*d* includes a sill middle plastic section 12*d*, a sill outer metal member 14*d* and a sill inner metal member 16*d* (see FIG. 14).

Further, in a preferred embodiment, the PVC hollows of each of the middle plastic members 12 are filled with co-extruded and integrally bonded PVC foam insulation 18 (k=approximately 33 mW/m-K). The PVC foam insulation 18 preferably enhances the thermal performance and provides structure enhanced stiffness and durability for the middle plastic sections. In another embodiment, the insulation 18 can comprise a material other than PVC.

In a preferred embodiment, the extruded PVC members or middle plastic members 12 are thermally welded at the corners. As shown in the figures, the middle plastic members 12 can have mitered edges where the separate pieces are joined. However, this is not a limitation on the present invention. This provides a tight seal helping prevent infiltration air. The welding provides a bond that is preferably stronger than the base extrusion material. The PVC foam insulation 18 allows for thermal welding without contaminating the joint.

Figure 17:
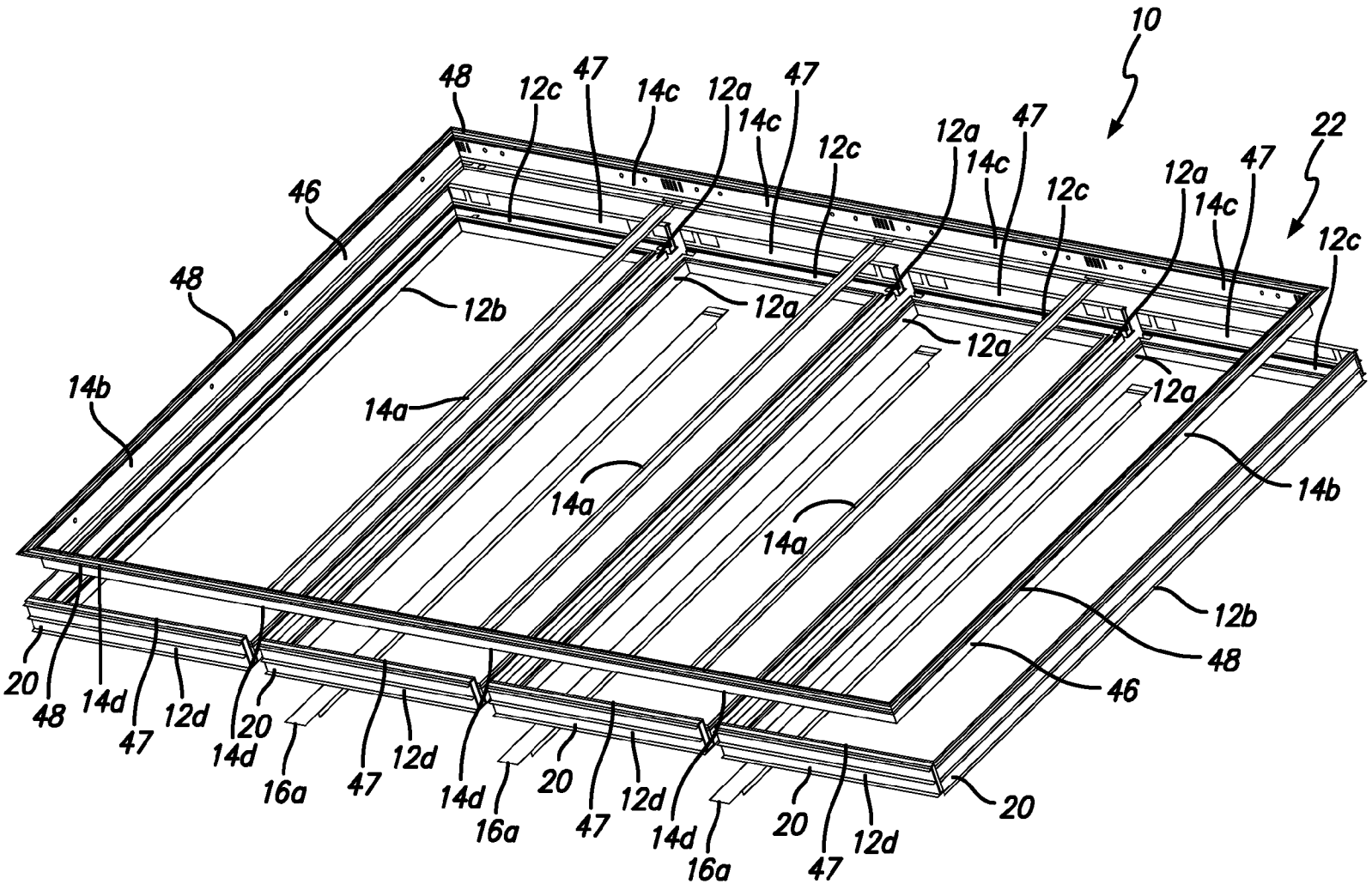
FIG. 17 is an exploded perspective view of the frame 10 showing the frame outer, the single door-assemblies made up of the middle plastic sections and the mullion inner metal members.

In a preferred embodiment, as shown in FIG. 17, the four welded middle plastic sections 12 form a single-door assembly or plastic module 20. It will be appreciated that, depending on the number of door openings provided in the frame 10, the four welded middle plastic sections 12 will generally include a sill middle plastic section 12*d*, a header middle plastic section 12*c*, a mullion middle plastic section 12*a* and either another mullion middle plastic section 12*a* (if the door opening is not on an end) or a jamb middle plastic section 12*b* (if the door opening is on an end).

As shown in FIG. 17, the outer metal members 14 (14*a*, 14*b*, 14*c* and 14*d*) are secured to one another. They can be secured in various ways, such as welding, riveting, screwing, bolting, adhering, etc. In a preferred embodiment, they are welded at the corner sections and screwed together at the T-joints (mullion sections) to form a frame outer 22 that comprises one to six door framesets (four are shown in FIG. 1). FIG. 17 is an exploded perspective view that shows the frame outer 22, the single door-assemblies 20 that are made up of the middle plastic sections (12*a*, 12*b*, 12*c* and 12*d*) and the mullion inner metal members 16*a*. The jamb, header and sill inner metal members 16*b*, 16*c* and 16*d* are omitted. FIG. 17 shows the single door-assemblies 20 exploded away from each other to illustrate that, in a preferred embodiment, they are not adhered or otherwise secured to one another.

Figure 2:
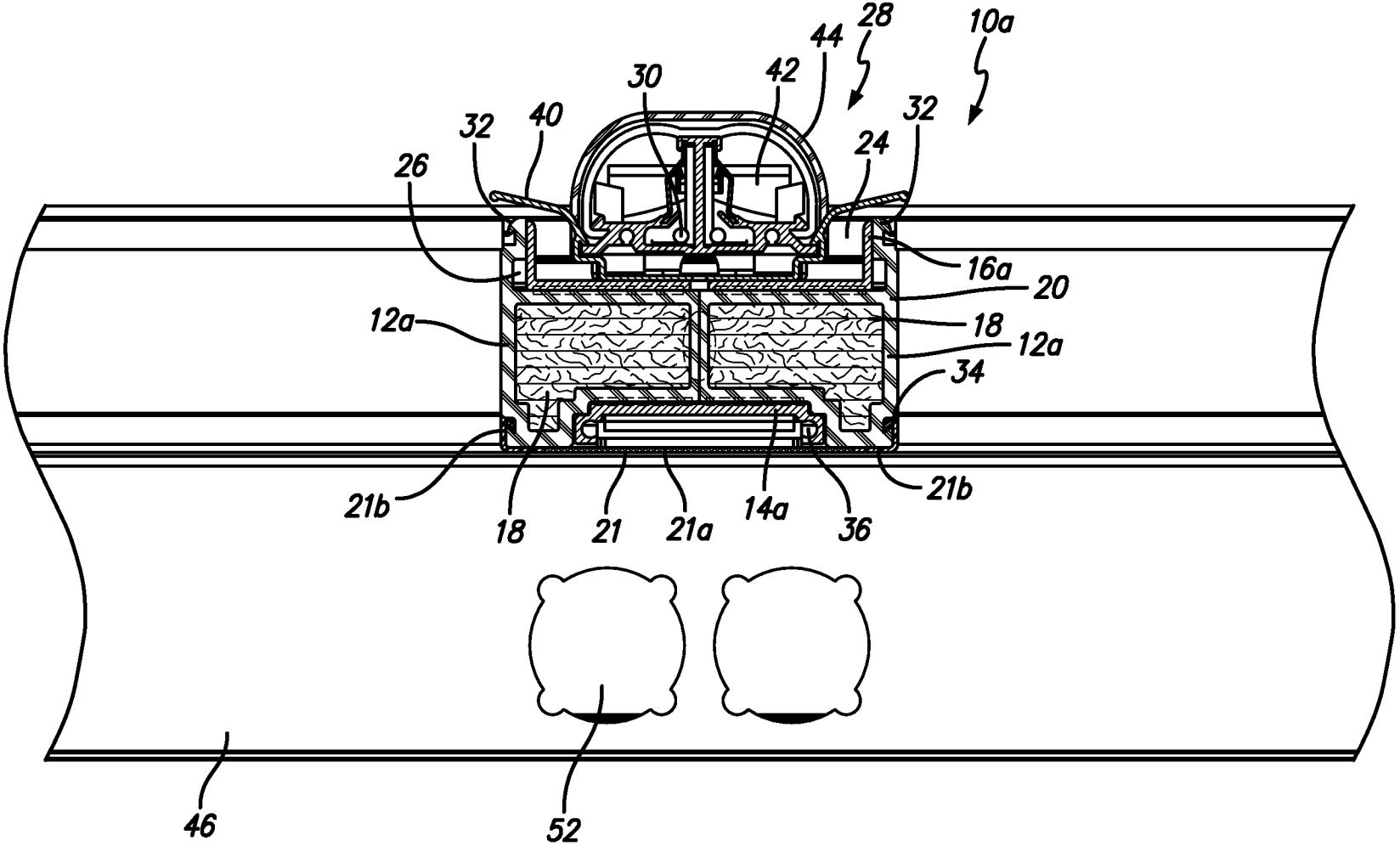
FIG. 2 is a cross-sectional top plan view taken along line 2-2 of FIG. 1 showing the split mullion section.
Figure 4:
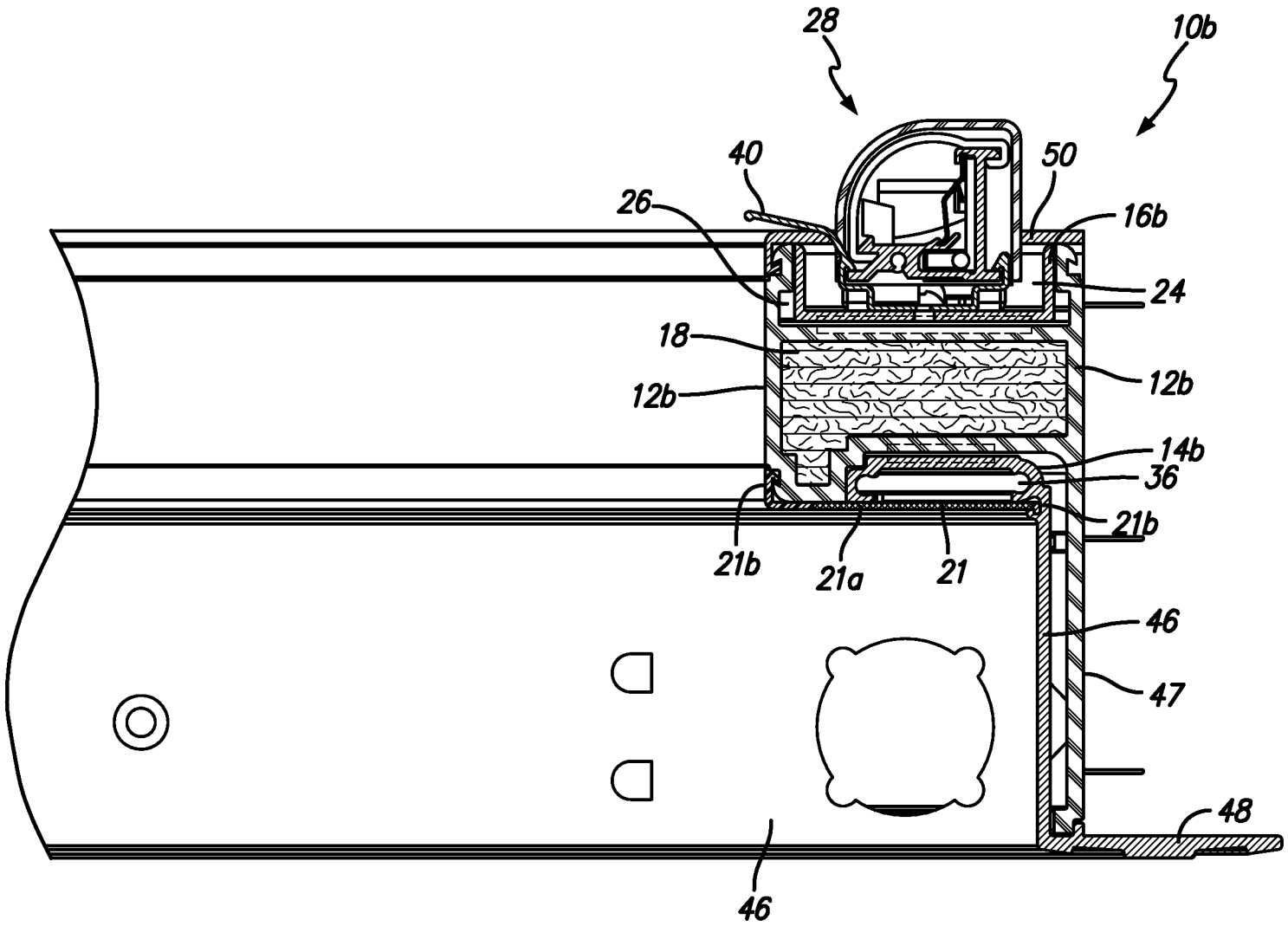
FIG. 4 is a cross-sectional top plan view taken along line 4-4 of FIG. 1 showing the jamb section.
Figure 6:
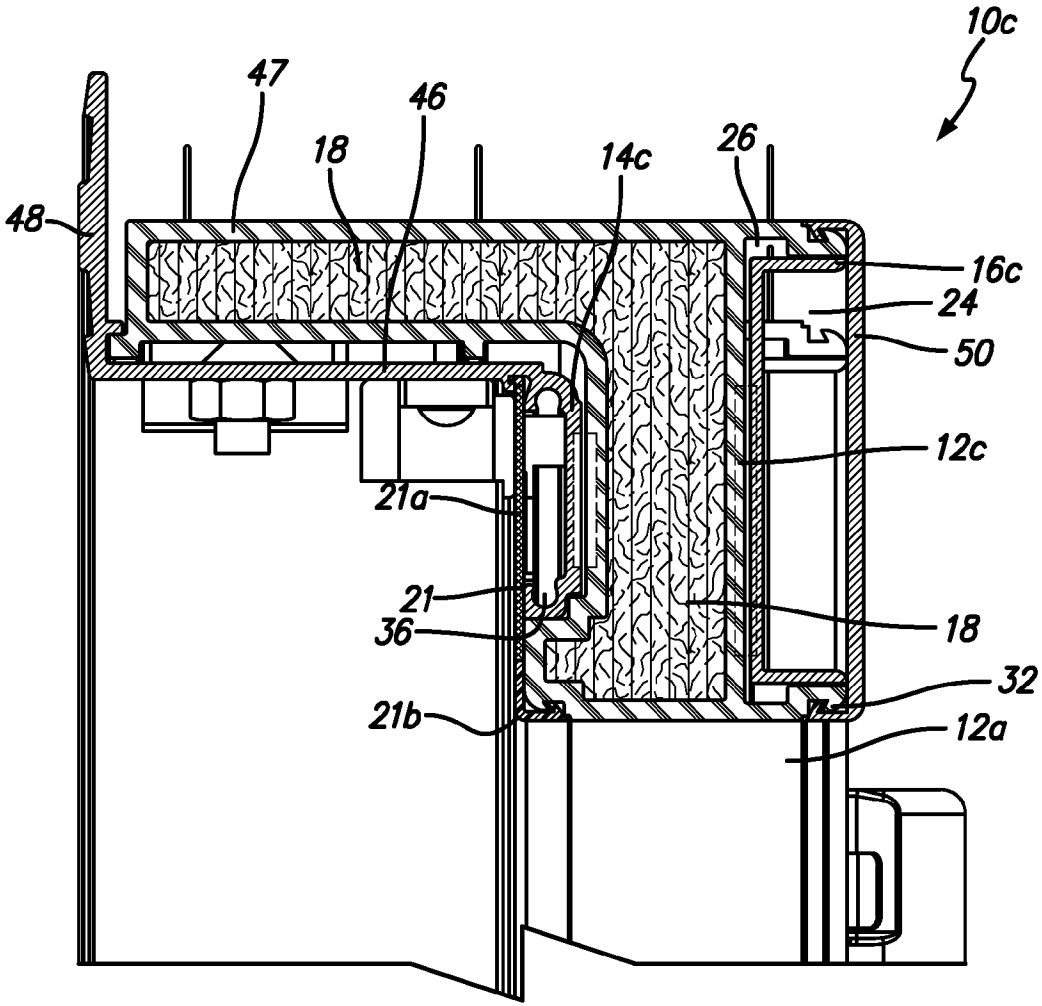
FIG. 6 is a cross-sectional elevational view taken along line 6-6 of FIG. 1 showing the header section.

The compliant adhesive or acrylic tape bonding the single door assemblies 20 to the multi-door aluminum frame outer 22 allows for the large differences in CTE and resultant thermal shrink of the PVC assemblies 20 relative to the aluminum frame outer 22 without overstressing and cracking the PVC. Effectively, these are like expansion joints on a concrete road. The tape and/or adhesive is not shown in the drawings, but FIG. 2 shows circles for the preferred areas where the mullion middle plastic sections 12*a* are bonded to the mullion outer metal member 14*a* and mullion inner metal member 16*a*. FIG. 2 also includes a dashed oval to show that the two adjacent mullion middle plastic sections 12*a* (of separate single door assemblies 20) are not bonded to one another where they abut one another. FIG. 4 shows circles for the preferred areas where the jamb middle plastic sections 12*b* are bonded to the jamb outer metal member 14*b* and jamb inner metal member 16*b*. FIG. 6 shows circles for the preferred areas where the header middle plastic sections 12*c* are bonded to the header outer metal member 14*c* and header inner metal member 16*c*. The bond locations shown in the figures are not limitations on the invention. The bond can be provided in different or more or less locations.

Figure 15:
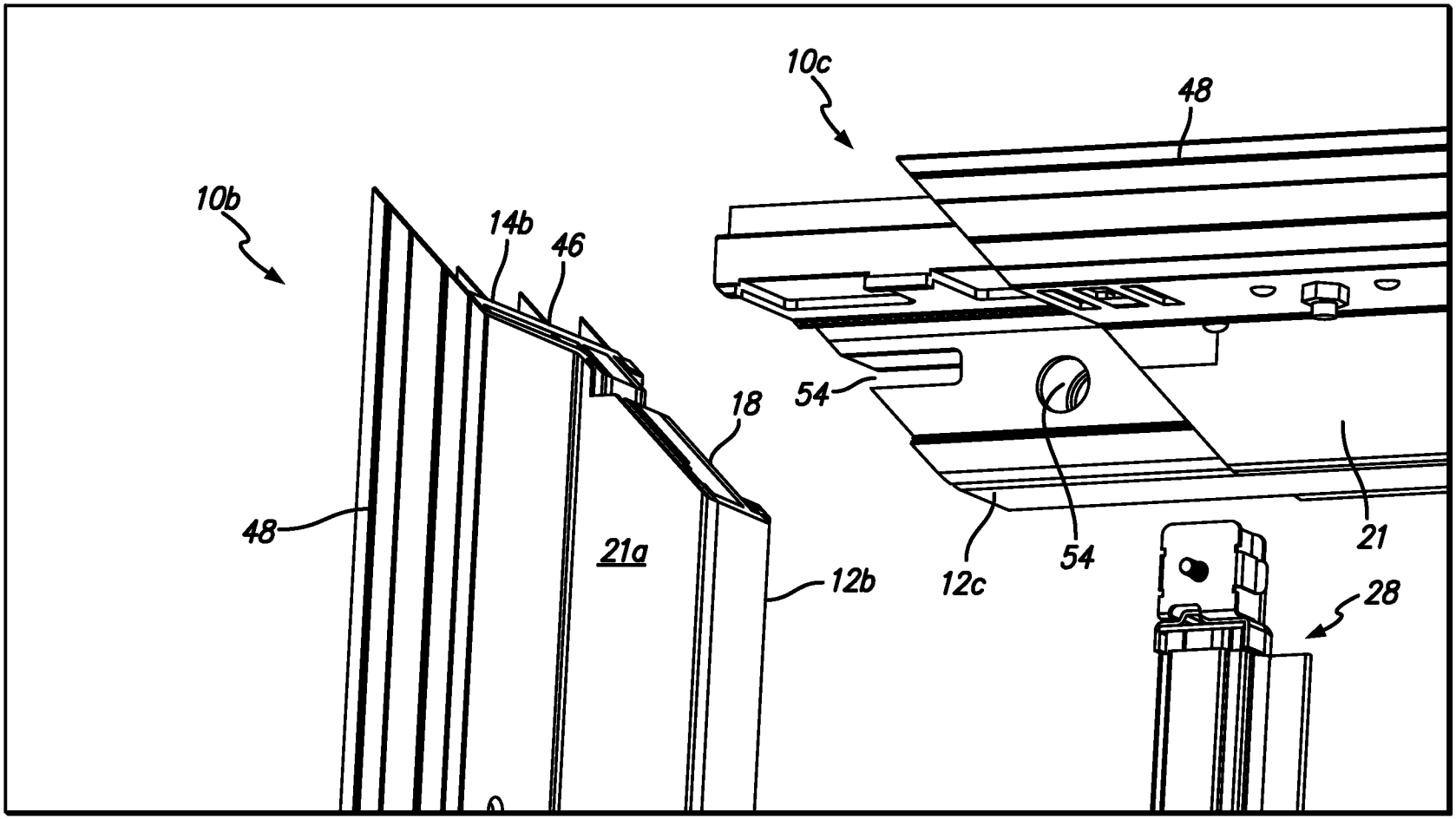
FIG. 15 is an outer exploded perspective view of the top left corner of the frame.
Figure 16:
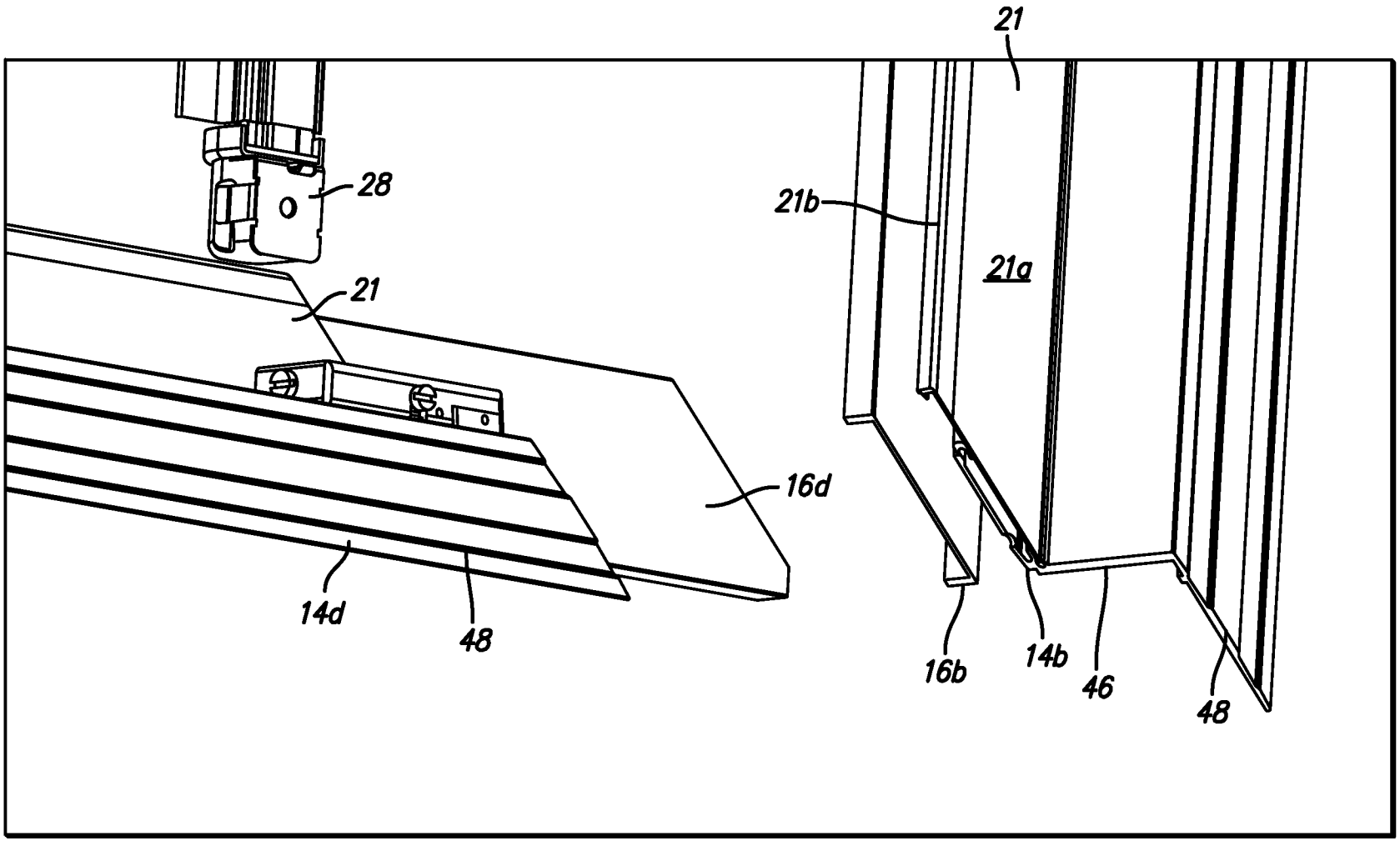
FIG. 16 is an outer exploded perspective view of the bottom right corner of the frame with the middle plastic sections removed.

The aluminum/PVC/aluminum sandwich provides a thermal break (as a result of the PVC) with a high stiffness (as a result of the aluminum). Additionally, the PVC foam insulation 18 integrally extruded and bonded to the cavities in the PVC extrusions adds further stiffness and toughness required from the doors slamming against the frame 10. In another embodiment, to improve the stiffness of the PVC extrusion and reduce the required aluminum, embedded glass roving can be co-extruded and strategically located in the perimeter. This would also reduce thermal shrink of the PVC in the freezer ambient. As shown in FIG. 15, the middle plastic sections 12 can include openings 54 therein for various components, such as wires that extend from the cold zone to the hot zone.

Figure 3:
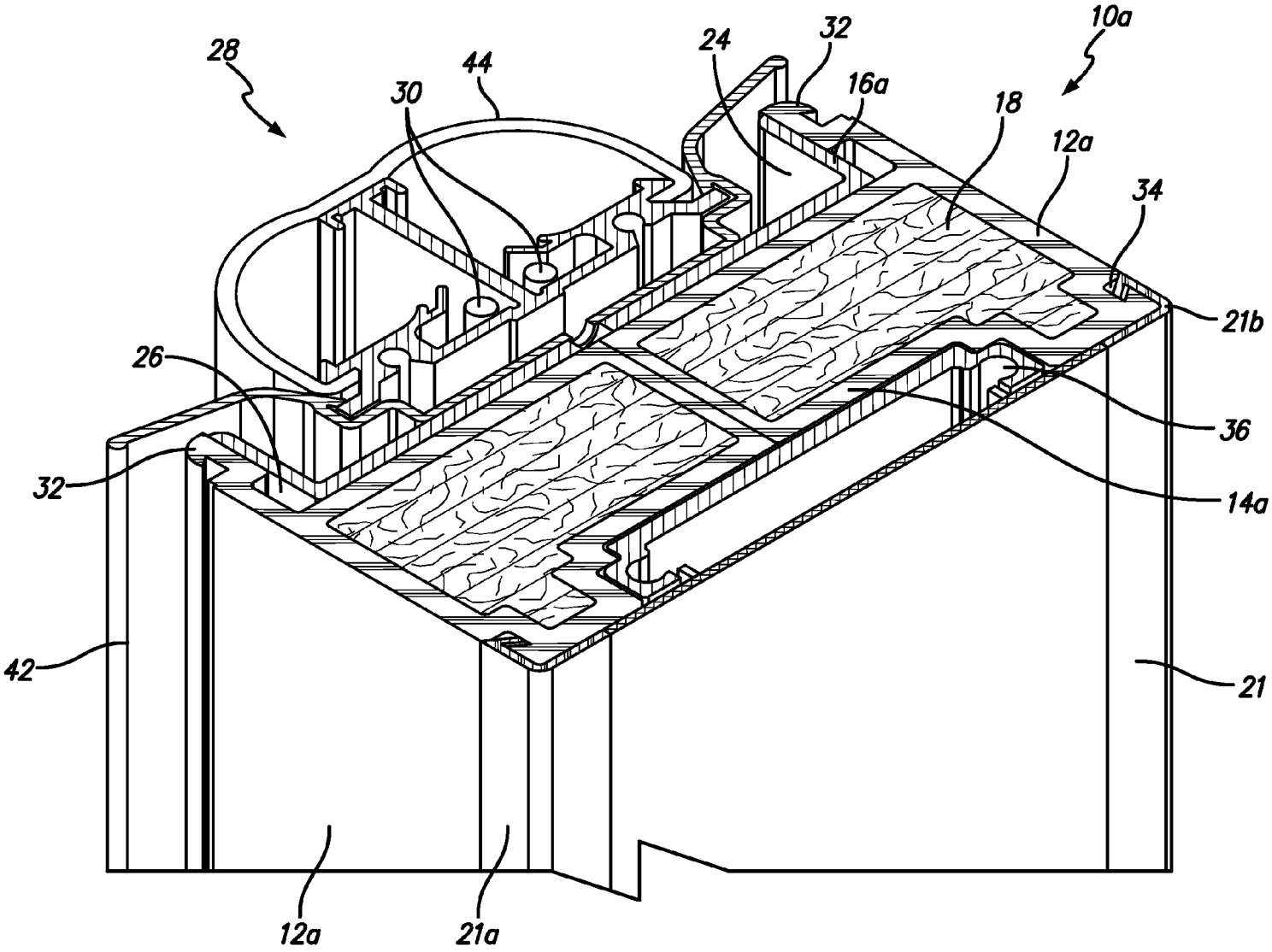
FIG. 3 is a cross-sectional perspective view taken along line 2-2 of FIG. 1 showing the split mullion section.

FIGS. 2 and 3 show a cross-section of a mullion section 10*a*. Mullion section 10*a* includes two mullion middle plastic sections 12*a* (from adjacent single-door assemblies 20), mullion outer metal member 14*a*, mullion inner metal member 16*a* and seal plate 21. As shown in FIGS. 2 and 3, in a preferred embodiment, inner metal member 16*a* is generally U-shaped and defines a channel 24 therein. The U-shaped inner metal member 16*a* is positioned in a U-shaped cavity 26 formed on the back of the adjacent middle plastic sections 12*a*. It will be appreciated by those skilled in the art that channel 24 serves multiple purposes: side-shielding from visible source of the LED light fixture 28, thermal insulation from the dead air space, and it provides a wireway for the light fixture wires 30.

Cavity 26 receives the inner metal member or U-shaped aluminum stiffener 16*a*, which helps to stiffen the large PVC frame comprised of the separate single door assemblies 20. In another embodiment, the separate single door assemblies 20 can be welded or otherwise secured together. As shown in FIG. 3, the mullion middle plastic section 12*a* can also include hooks 32 for receiving a cover (not shown) that can cover the U-shaped inner metal member 14*a* along a portion of its length where there is no light fixture.

Figure 18:
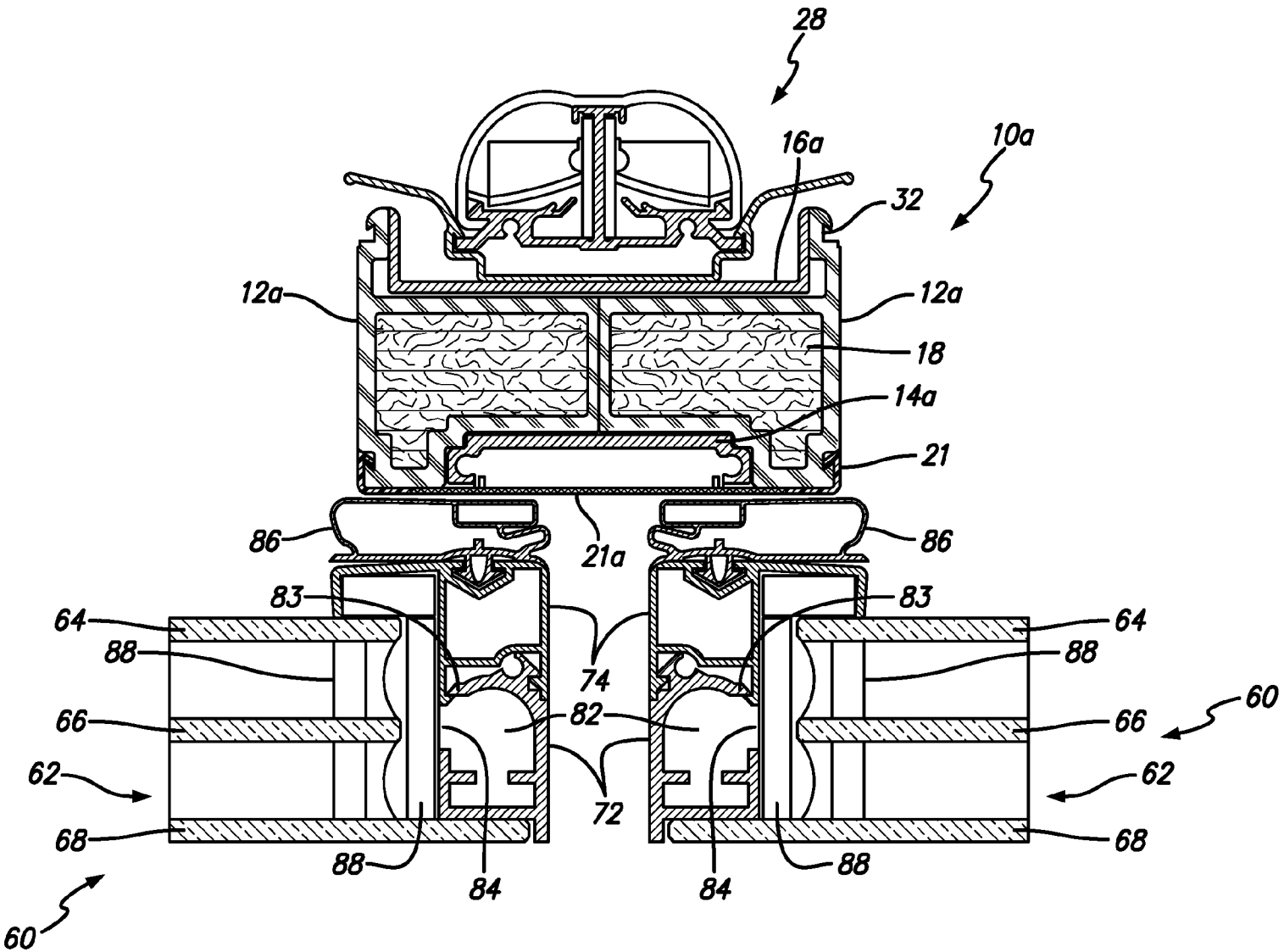
FIG. 18 is a cross-sectional top plan view of the mullion section of the frame with two doors secured thereto in accordance with an embodiment of the invention.
Figure 19:
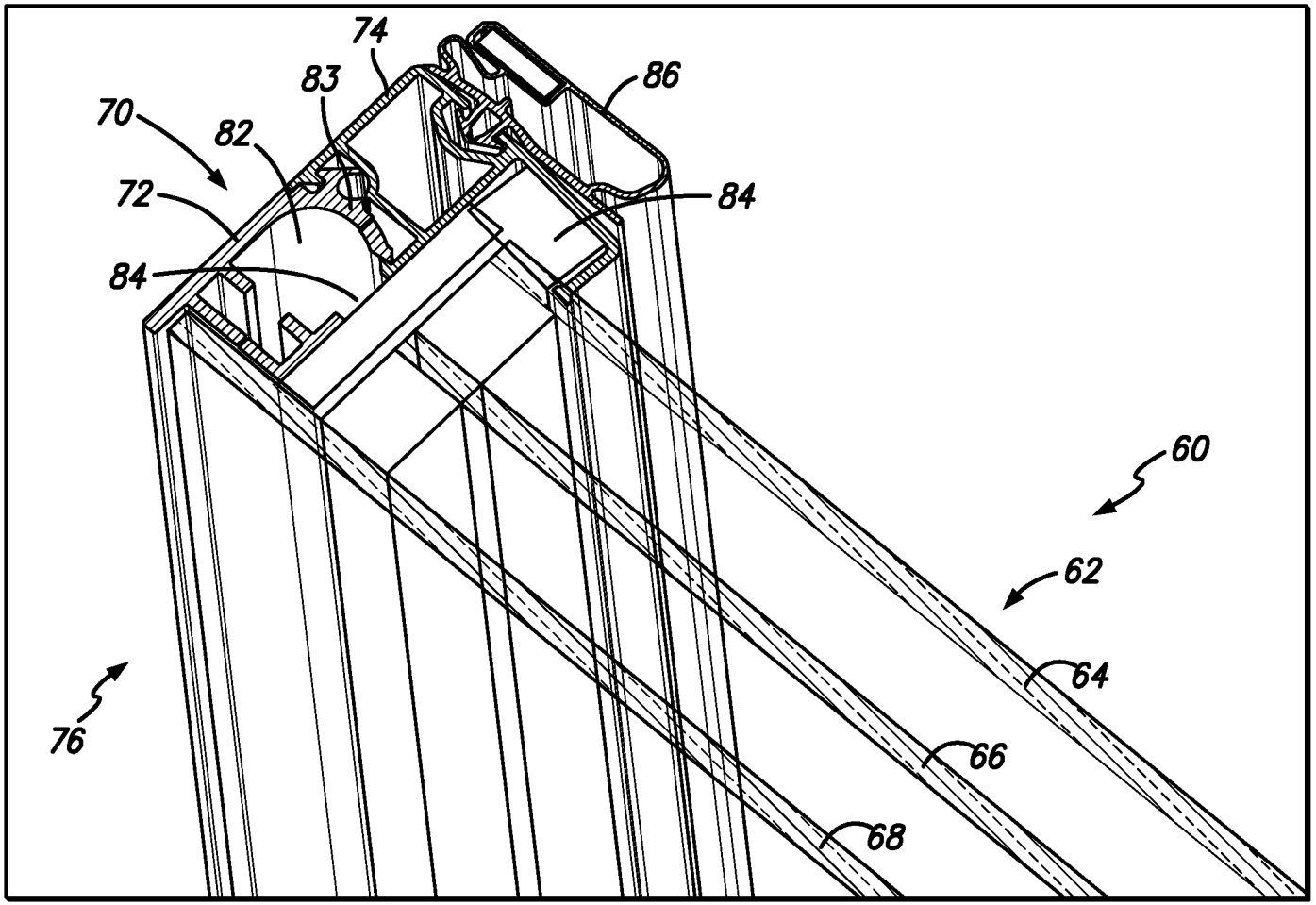
FIG. 19 is a cross-sectional perspective of the hinge side of the door of FIG. 18.

In a preferred embodiment, the seal plate 21 is comprised of encapsulated co-extruded steel sheetmetal in PVC to comprise the seal plate 21. Therefore, the seal plate 21 includes a center metal section 21*a* encapsulated in flexible PVC and includes legs 21*b* that each include a hook that is snap fit into corresponding recesses 34 in the middle plastic sections 12*a*. This provides easy removal for servicing components therebehind, without resulting in any protrusions from the flat surface that might cause the door magnetic gasket 86 (see FIG. 18) to catch and roll, while providing the necessary iron behind a thin plastic skin (see FIG. 22) for the magnetic gasket 86 to attract and seal. In another embodiment, the metal section can be exposed and not be located behind the plastic skin. In another embodiment, the entire seal plate can be metal.

Figure 22:
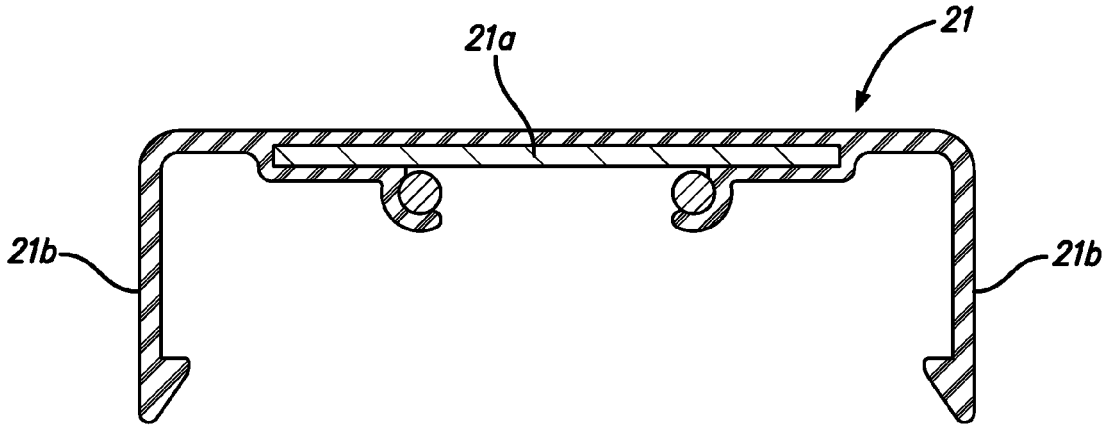
FIG. 22 is a cross-sectional top plan view of another embodiment of the seal plate of the frame with clips for the anti-sweat heater wires.
Figure 23:
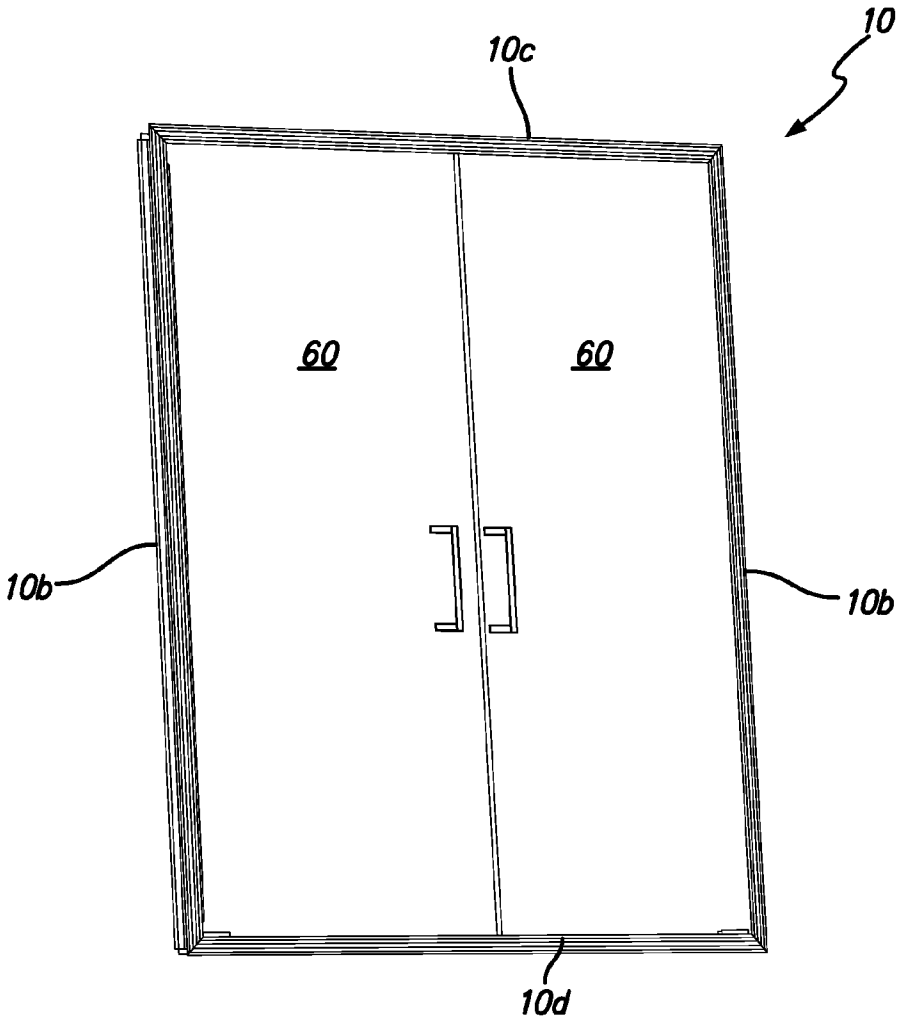
FIG. 23 is a perspective view of a door frame assembly that includes a door frame and first and second doors.

In a preferred embodiment, the outer metal member 14*a* includes at least one wire groove 36 defined therein. Preferably, anti-sweat heater wires (not shown) for heating the seal plate 21 run in this groove 36. As shown in FIG. 22, in another embodiment, the anti-sweat heater wire can be in direct contact with the metal section 21*a* of the seal plate 21. In this embodiment, the seal plate 21 includes members or clips 21*c* that define grooves 21*d* therein that receive the anti-sweat heater wires. Any size anti-sweat heater is within the scope of the present invention.

FIGS. 2 and 3 also show the light fixture 28 and associated components (e.g., side shield 40, reflectors 42, plastic shield 44, etc.), all of which are standard and therefore will not be described herein.

Figure 5:
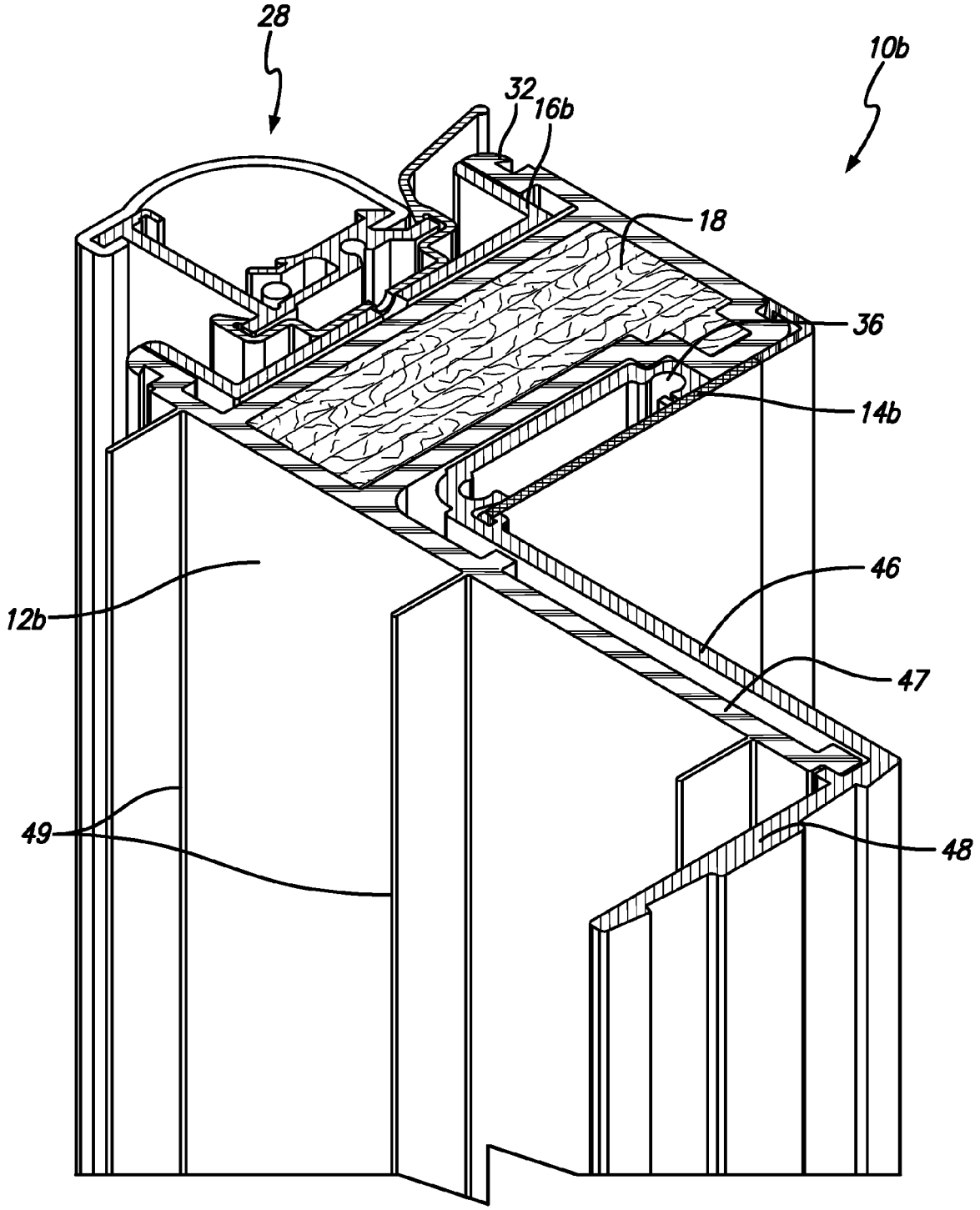
FIG. 5 is a cross-sectional perspective view taken along line 4-4 of FIG. 1 showing the jamb section.

FIGS. 4-5 show a cross-section of a jamb section 10*b*. Jamb section 10*b* includes jamb middle plastic section 12*b*, jamb outer metal member 14*b*, jamb inner metal member 16*b* and seal plate 21. In a preferred embodiment, jamb inner metal member 16*b* is generally U-shaped and defines a channel 24 therein. The U-shaped inner metal member 16*b* is positioned in a U-shaped cavity 26 formed on the back of the jamb middle plastic section 12*b*.

As shown in FIGS. 4-5, the seal plate 21 in the jamb section 100*b* differs slightly from the seal plate 21 in the mullion section 10*a*. It includes center metal section 21*a* and includes different hooks on the PVC legs 21*b*, one that secures the seal plate 21 to the jamb middle plastic section 12*b* and one that secures the seal plate 21 to the jamb outer metal member 14*b*.

In a preferred embodiment, the jamb outer metal member 14*b* and the jamb middle plastic section 12*b* each include an arm 46 and 47, respectively, extending therefrom, as shown in FIG. 4. Also, the jamb outer metal member 14*b* includes a flange 48 extending from the arm 46. The arm 46 and flange 48 form an area where the frame 10 can be inserted into and secured to a display case or cabinet. As shown in FIG. 5, arm 47 includes wipers 49 that help seal against a case into which the frame 10 is inserted.

Figure 7:
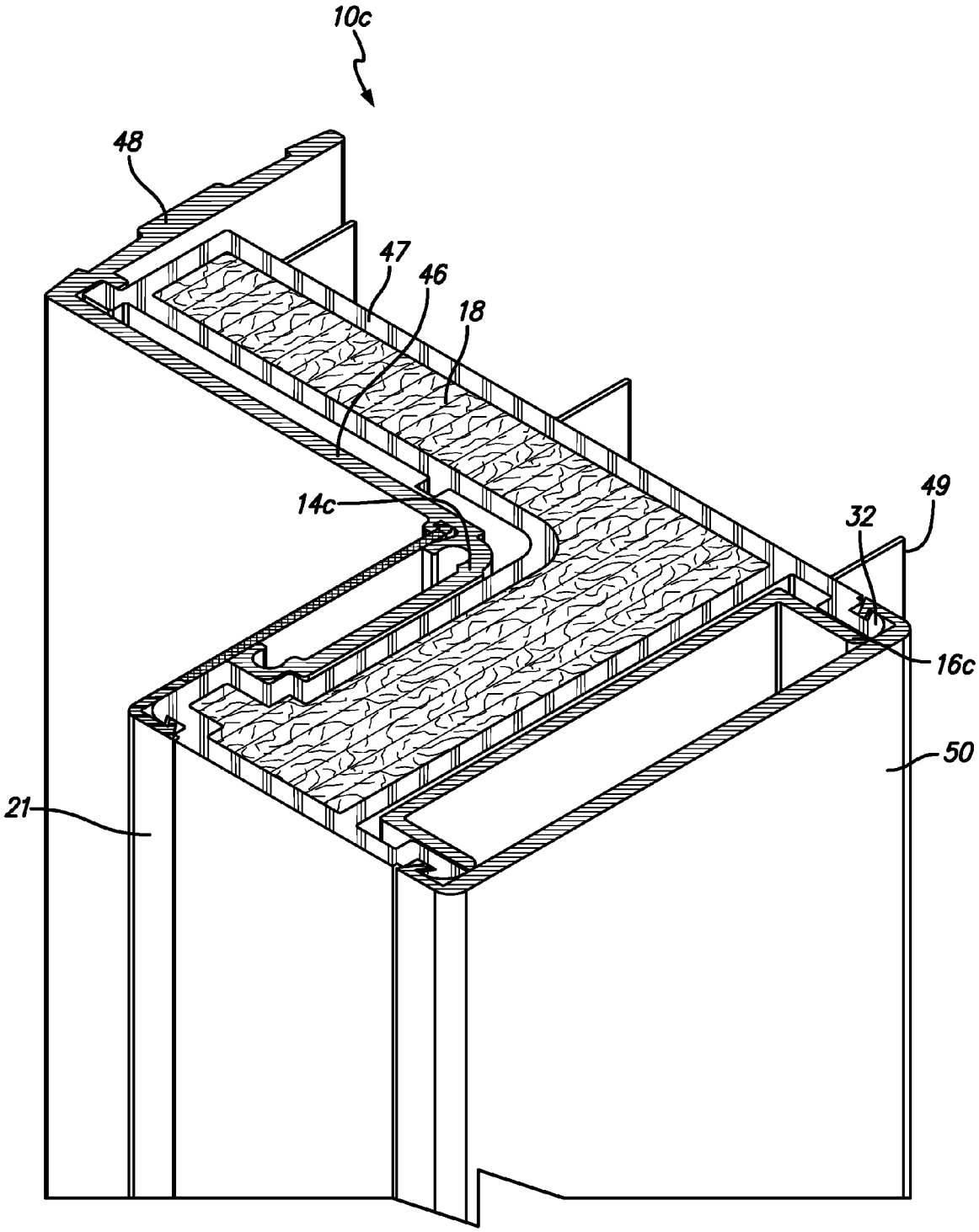
FIG. 7 is a cross-sectional perspective taken along line 6-6 of FIG. 1 showing the header section.
Figure 8:
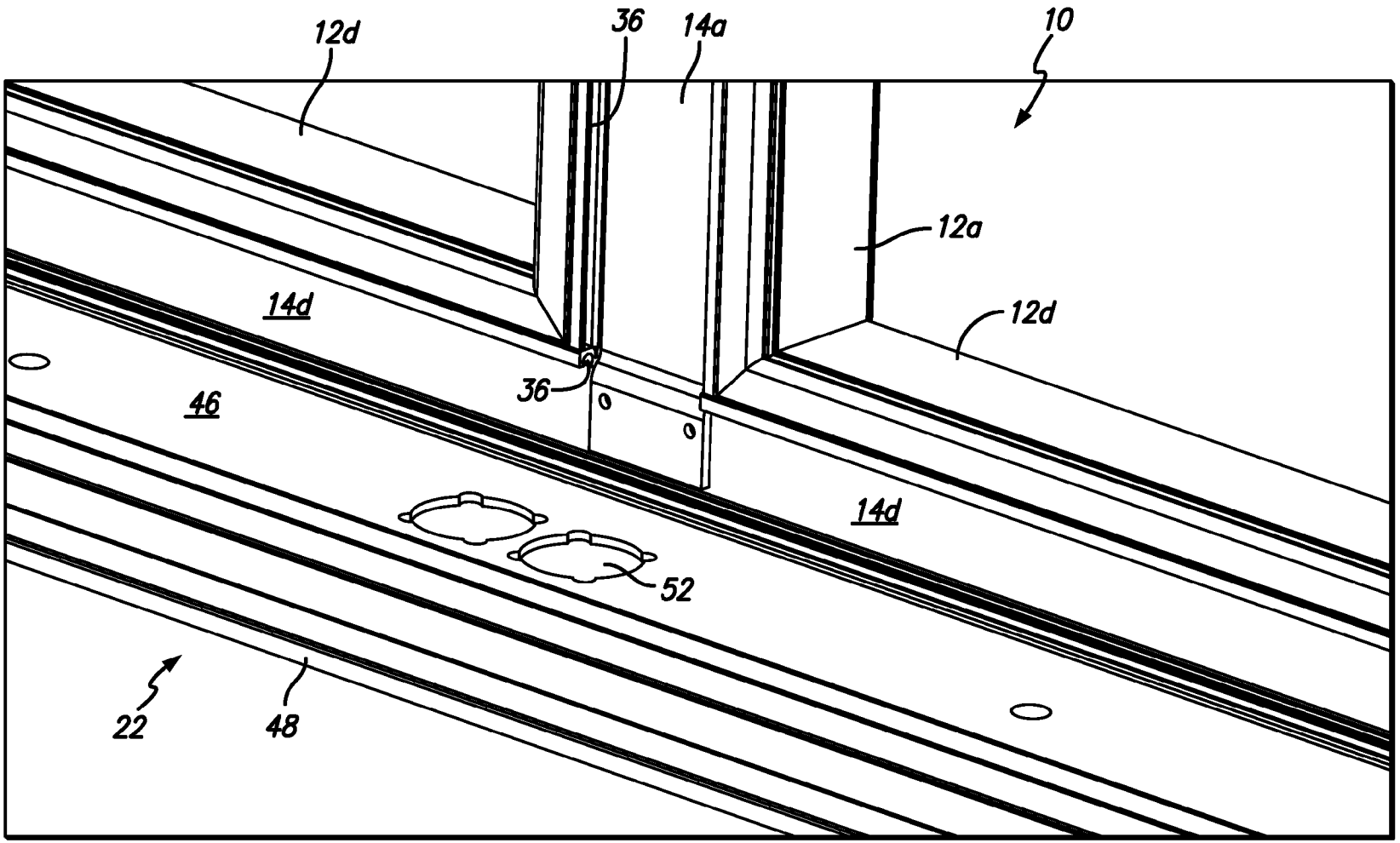
FIG. 8 is an outer perspective view of a mullion section and sill section of the frame with the seal plates omitted.
Figure 9:
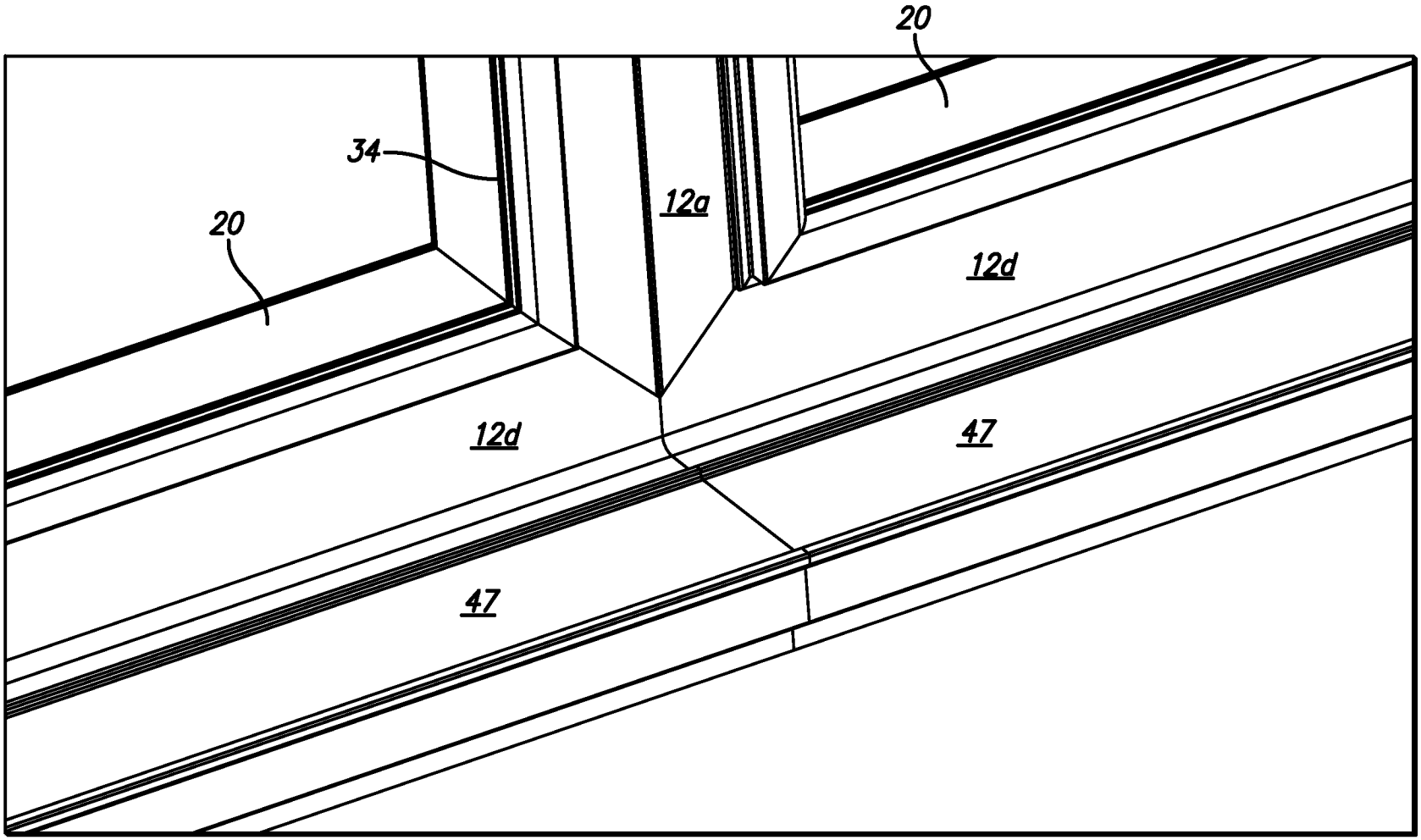
FIG. 9 is a is an outer perspective view of the middle plastic sections of a mullion section and sill section.
Figure 10:
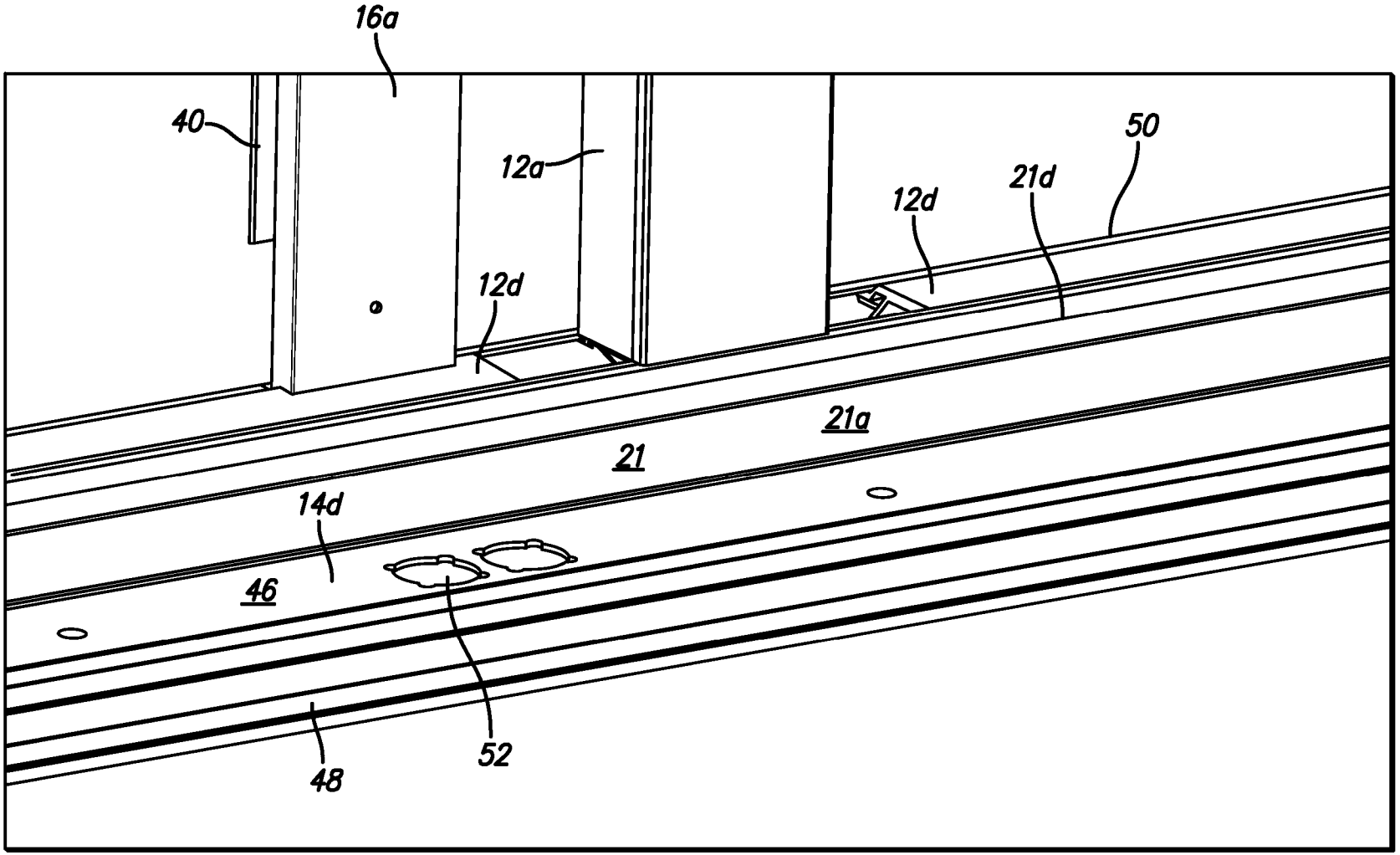
FIG. 10 is an outer exploded perspective view of a mullion section and sill section of the frame.
Figure 11:
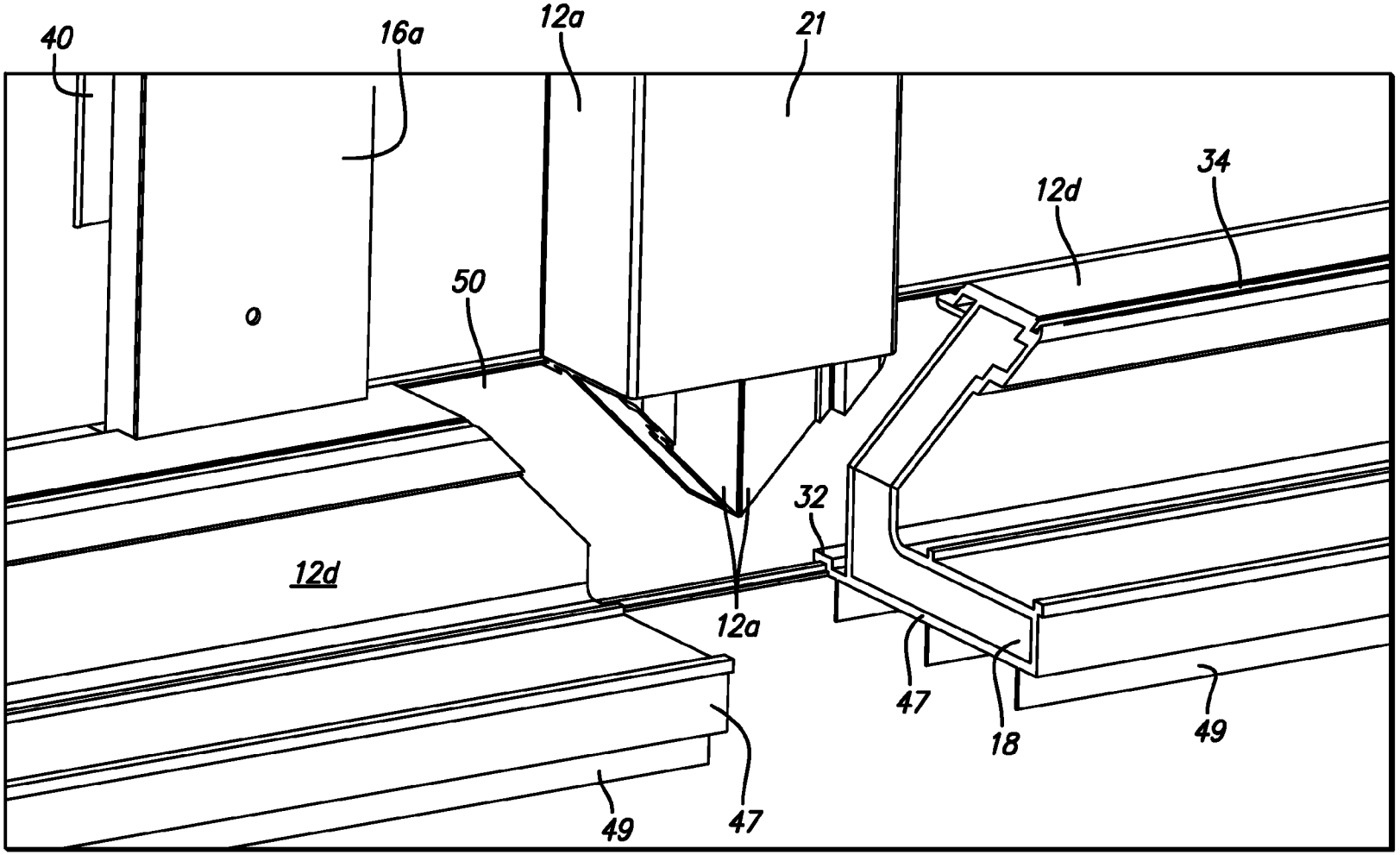
FIG. 11 is another outer exploded perspective view of a mullion section and sill section of the frame with the seal plate and outer metal member removed from the sill section.
Figure 12:
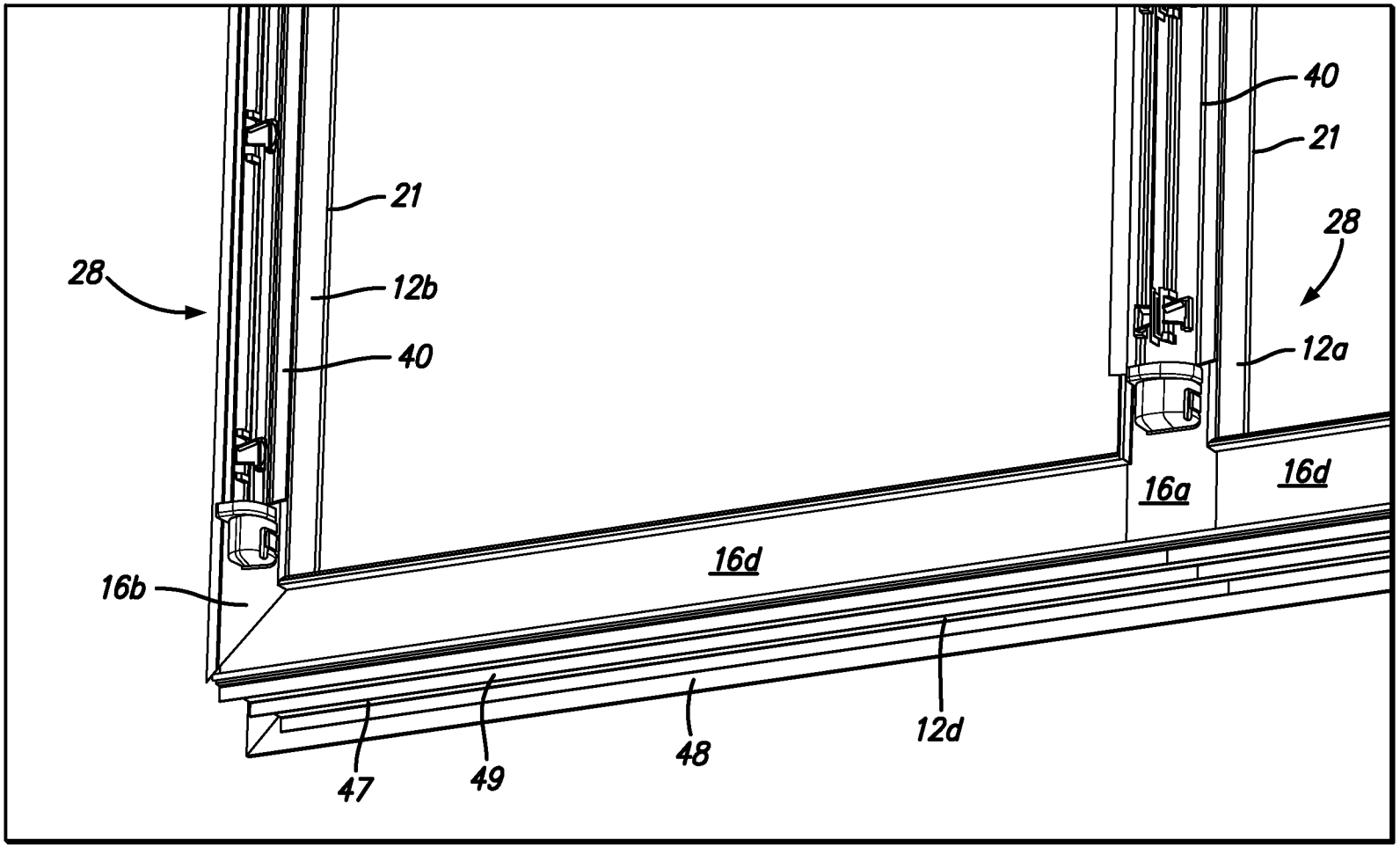
FIG. 12 is an inner perspective view of a portion of the frame.
Figure 13:
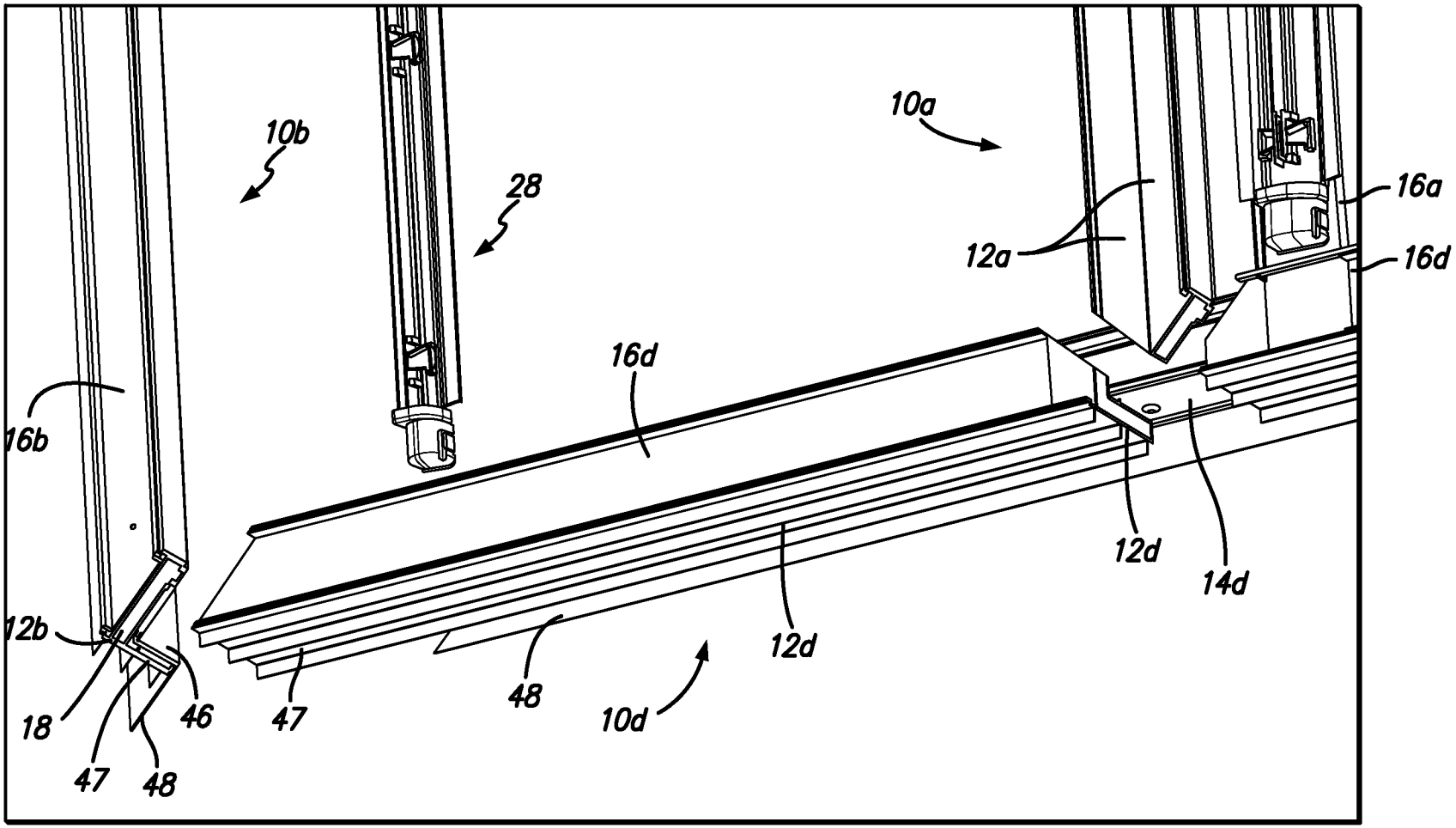
FIG. 13 is an exploded inner perspective view of the same portion of the frame as FIG. 12.

FIGS. 6-7 show a cross-section of a header section 10*c*. Header section 10*c* includes header middle plastic section 12*c*, header outer metal member 14*c*, header inner metal member 16*c* and seal plate 21. In a preferred embodiment, header inner metal member 16*c* is generally U-shaped and defines a channel 24 therein. The U-shaped inner metal member 16*c* is positioned in a U-shaped cavity 26 formed on the back of the header middle plastic section 12*c*.

As shown in FIGS. 6-7, the seal plate 21 in the header section 10*c* includes center metal section 21*a* and includes different hooks on the PVC legs 21*b*, one that secures the seal plate 21 to the header middle plastic section 12*c* and one that secures the seal plate 21 to the header outer metal member 14*c*.

In a preferred embodiment, the header outer metal member 14*c* and the header middle plastic section 12*c* each include an arm 46 and 47, respectively extending therefrom, as shown in FIG. 6. Also, the header outer metal member 14*c* includes a flange 48 extending from the arm 46. The arm 46 and flange 48 form an area where the frame 10 can be inserted into and secured to a display case or cabinet. As shown in FIG. 6, in this embodiment, the arm 47 on the header middle plastic section 12*c* includes space therein for insulation 18. Preferably, the header middle plastic section 12*c* includes hooks 32 that secure a cover 50 thereto. Wires can be positioned in the space defined by the cover 50 and the header inner metal member 16*c*.

It will be understood that the sill section 10*d* is essentially a mirror image of the header section 10*c* shown in FIGS. 6-7. See FIG. 14 for an exploded perspective of the sill section 10*d*. As shown in the figures, the arm 46 of sill outer metal member 14*d* includes cut outs 52 for a bottom hinge socket receptacle.

In a preferred embodiment, the relatively large area of aluminum around the perimeter (header, sill, and jams, not mullion) acts as a heat sink, which conducts heat from the warm room to the seal plate 21.

With reference to FIGS. 18-21, in a preferred embodiment, the frame 10 includes at least one door 60 hingedly secured therein. In a preferred embodiment, the door 60 is hingedly connected to the header and the sill, as is known in the art. In a preferred embodiment, the door 60 includes an offset glass pack 62. Preferably the offset glass pack 62 includes inner 64, middle 66 and outer 68 panes, with the outer pane 68 being larger, as shown in FIGS. 18-21. The door 60 includes a peripheral outer rail assembly 70 that includes a series of top, bottom, hinge side and handle side rails 70*a*, 70*b*, 70*c* and 70*d* that define a space therebetween. In a preferred embodiment, the peripheral outer rail assembly 70 (and each of the separate components—top, bottom, hinge side and handle side rails 70*a*, 70*b*, 70*c* and 70*d*) include a metal rail portion 72 (that is preferably aluminum) and a plastic rail portion 74. The outer pane 68 is bonded to the metal rail portions 72 along the hinge side 76 (FIGS. 18-19), handle side 78 (FIG. 20), top 80 (FIG. 21) and bottom. This can be done with glazing adhesive or the like. Also, the metal rail portions 72 do not extend forward of the outer pane 68, which provides a frameless door look.

In a preferred embodiment, the metal rail portion 72 includes a hinge opening 82 extending the length thereof. The hinge opening 82 is at least partially defined by a C-shaped portion 83 of the metal rail portion 72 that has a general "C" shape and includes a gap 84 adjacent the glass pack 62. The gap 84 makes the heat conduction path longer from the warm to the cold zone, which preferably makes the door more thermally efficient and better insulated. The gap 84 also provides space to route wires in an embodiment where wires are routed to the glass or there is anti-sweat perimeter heat.

In a preferred embodiment, the rail 70 includes a metal rail portion 72 and a plastic rail portion 74. This is done so that metal only extends minimally innerwardly toward the cold zone to minimize conduction to the refrigerator/freezer. However, this is not a limitation on the present invention and the entire rail 70 can be metal or plastic and can be a single piece. The plastic rail portion 74 preferably includes the magnetic gasket 86 on the back thereof. As described above, the magnetic gasket 86 provides a seal with the metal center portion 21*a* of the seal plate 21 on the frame 10 or with another metal piece if the door 60 is used with a different frame. The door 60 can also include other foam insulation components 88, spacers or the like.

It will be understood that any type of metal can be used for the outer and inner metal members 14 and 16 and the metal rail portion 72, and any type of plastic can be used for the middle plastic sections, insulation 18, seal plate 21, and plastic rail portion 74. In a preferred embodiment, aluminum and PVC are used.

Figure 20:
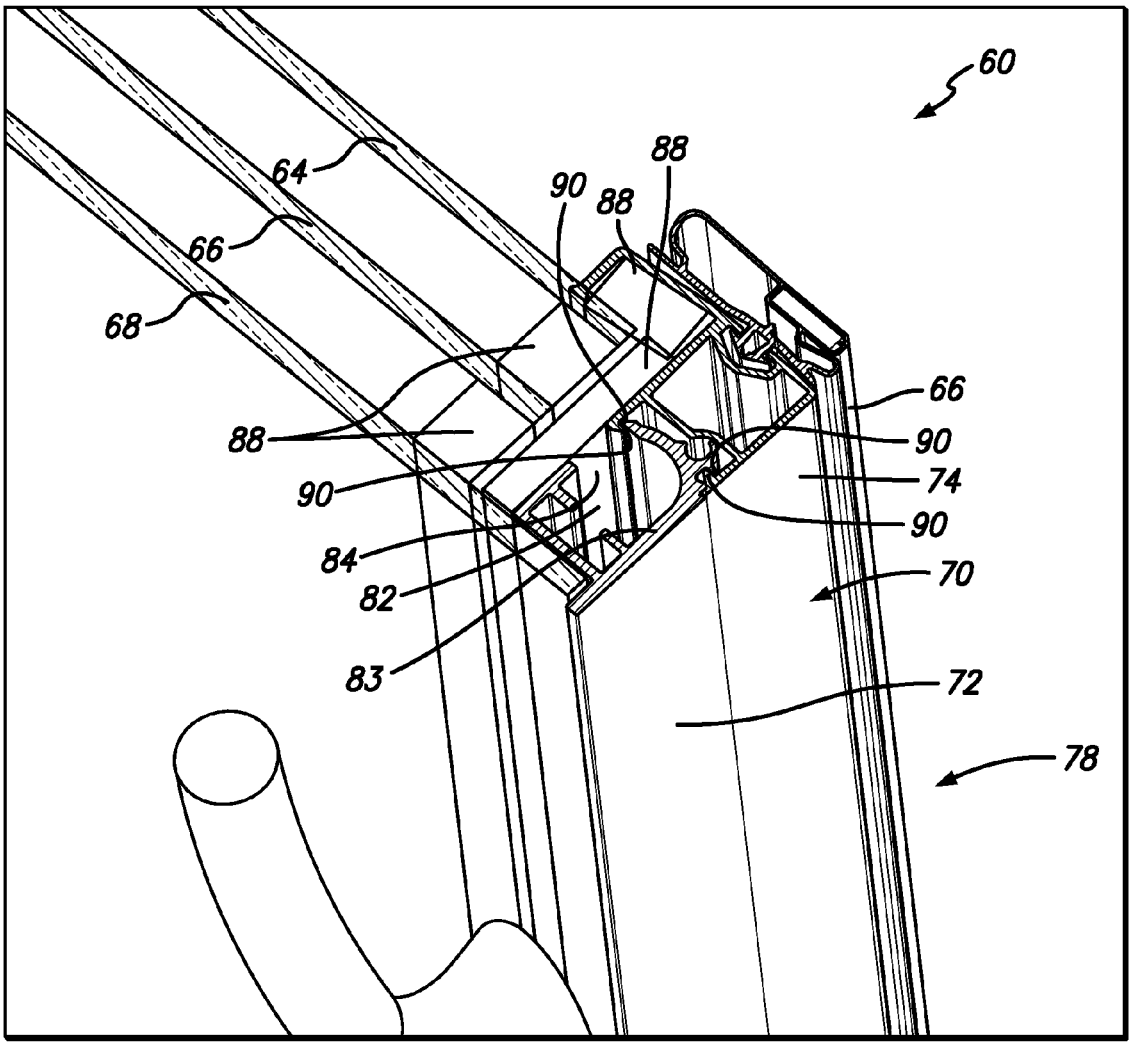
FIG. 20 is a cross-sectional perspective of the handle side of the door of FIG. 18.
Figure 21:
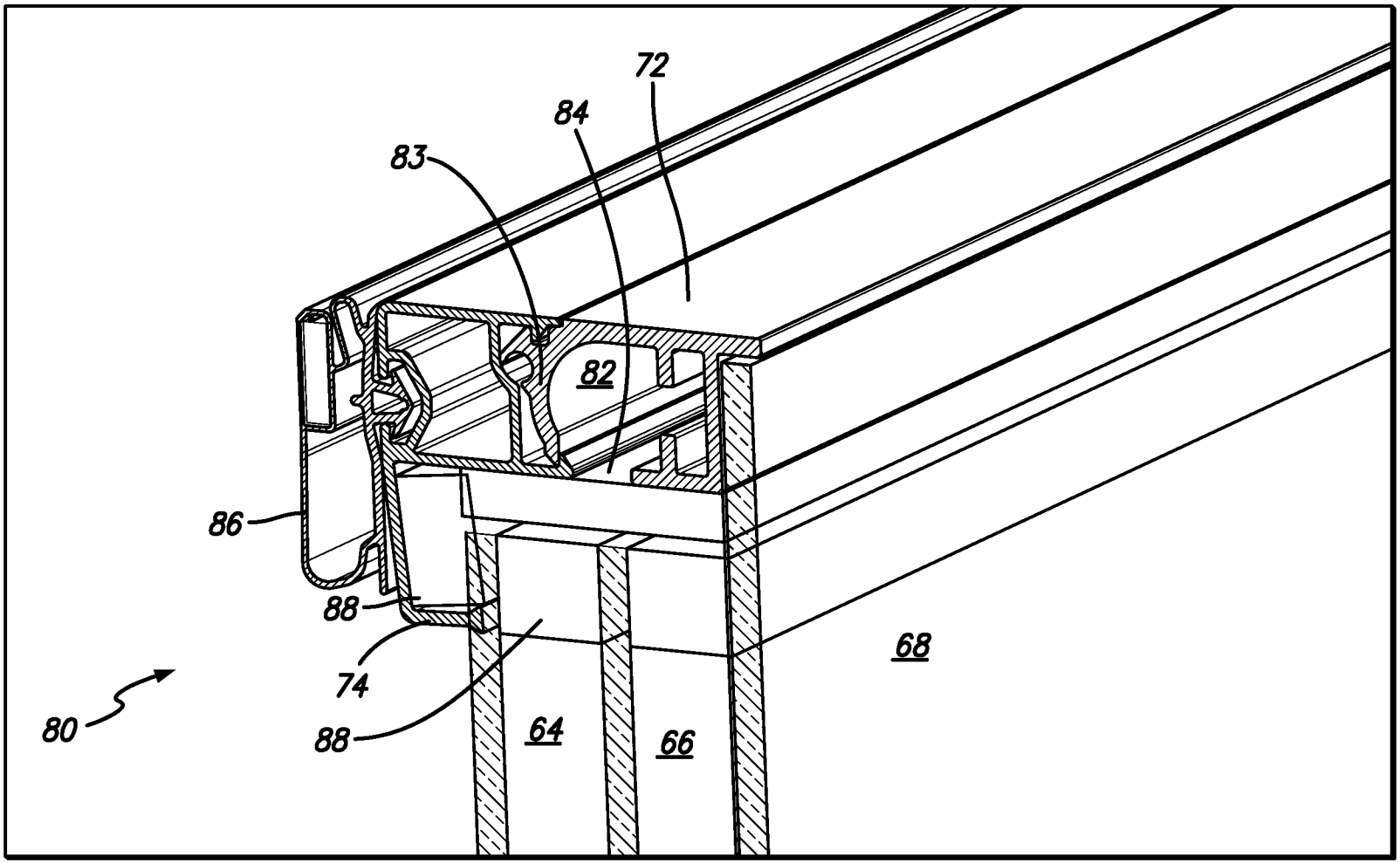
FIG. 21 is a cross-sectional perspective of the top side of the door of FIG. 18.

As shown in FIG. 20, in a preferred embodiment, the metal rail portion 72 and plastic rail portion 74 include opposing hooks 90 that snap fit onto one another and secure the metal rail portion 72 and plastic rail portion 74 to one another.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed, at different times. Further any specific numbers noted herein are only examples: alternative implementations may employ differing values or ranges.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. §112, ¶6, other aspects may likewise be embodied as a means-plus-function claim, or in other forms, such as being embodied in a computer-readable medium. (Any claims intended to be treated under 35 U.S.C. §112, ¶6 will begin with the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A door frame for a refrigerator display case, the frame comprising:

an inner metal member, an outer metal member, and first and second single plastic modules sandwiched between the inner metal member and the outer metal member, wherein the inner metal member, outer metal member and first and second plastic modules cooperate to define first and second door openings, wherein the first single plastic module includes a first jamb middle plastic section, a first header middle plastic section, a first sill middle plastic section and a first mullion middle plastic section, wherein the second single plastic module includes a second jamb middle plastic section, a second header middle plastic section, a second sill middle plastic section and a second mullion middle plastic section, wherein the first mullion plastic section is positioned adjacent the second mullion plastic section, wherein the first and second single plastic modules are adhered to the inner metal member and the outer metal member, and wherein the first mullion plastic section and the second mullion plastic section are not adhered to one another.

2. The door frame of claim 1 wherein the first mullion plastic section and the second mullion plastic section include a seal plate attached thereto.

3. The door frame of claim 2 wherein the seal plate comprises a center metal section and first and second outwardly extending plastic legs, wherein the first plastic leg is secured to the first mullion plastic section and the second plastic leg is secured to the second mullion plastic section.

4. The door frame of claim 3 wherein the center metal section is encapsulated in plastic and the first and second plastic legs each include a hook that is snap fit into a corresponding recess defined in the first mullion plastic section and the second mullion plastic section, respectively.

5. The door frame of claim 1 wherein the inner metal member comprises a u-shaped cross-section.

6. The door frame of claim 5 wherein the first mullion plastic section and the second mullion plastic section cooperate to define a first channel, and wherein the inner metal member is seated in the first channel.

7. The door frame of claim 6 wherein the outer metal member comprises a generally u-shaped cross-section.

8. The door frame of claim 7 wherein the first mullion plastic section and the second mullion plastic section cooperate to define a second channel, and wherein the outer metal member is seated in the second channel.

9. The door frame of claim 1 wherein the first and second single plastic modules are adhered to the inner metal member and the outer metal member by acrylic tape.

10. A refrigerator display case door frame assembly comprising:

a door frame that includes an inner metal member, an outer metal member, and first and second single plastic modules sandwiched between the inner metal member and the outer metal member, wherein the inner metal member, outer metal member and first and second plastic modules cooperate to define first and second door openings, wherein the first single plastic module includes a first jamb middle plastic section, a first header middle plastic section, a first sill middle plastic section and a first mullion middle plastic section, wherein the second single plastic module includes a second jamb middle plastic section, a second header middle plastic section, a second sill middle plastic section and a second mullion middle plastic section, wherein the first mullion plastic section is positioned adjacent the second mullion plastic section, wherein the first and second single plastic modules are adhered to the inner metal member and the outer metal member, and wherein the first mullion plastic section and the second mullion plastic section are not adhered to one another, a first door hingedly disposed in the first door opening, wherein the first door includes a peripheral rail assembly that includes a top rail, bottom rail, hinge side rail and handle side rail that cooperate to define a space therebetween, wherein each of the top rail, bottom rail, hinge side rail and handle side rail include an outer metal rail portion and an inner plastic rail portion that are secured to one another, wherein at least the hinge side rail includes a hinge opening, a glass package secured within the space of the peripheral rail assembly, wherein the glass package includes an inner pane, a middle pane and an outer pane that are secured within the peripheral rail assembly, and a second door hingedly disposed in the second door opening, wherein the second door includes, a peripheral rail assembly that includes a top rail, bottom rail, hinge side rail and handle side rail that cooperate to define a space therebetween, wherein each of the top rail, bottom rail, hinge side rail and handle side rail include an outer metal rail portion and an inner plastic rail portion that are secured to one another, wherein at least the hinge side rail includes a hinge opening, a glass package secured within the space of the peripheral rail assembly, wherein the glass package includes an inner pane, a middle pane and an outer pane that are secured within the peripheral rail assembly.

* * * * *